US007861441B1

(12) United States Patent
Hoellwarth

(10) Patent No.: US 7,861,441 B1
(45) Date of Patent: Jan. 4, 2011

(54) GIFT CARD ENVELOPE

(76) Inventor: Quin C. Hoellwarth, 346 Emerald Ave., San Carlos, CA (US) 94070

( * ) Notice: Subject to any disclaimer, the term of this patent is extended or adjusted under 35 U.S.C. 154(b) by 955 days.

(21) Appl. No.: 10/745,914

(22) Filed: Dec. 23, 2003

Related U.S. Application Data

(60) Provisional application No. 60/436,721, filed on Dec. 24, 2002.

(51) Int. Cl.
*G09F 1/00* (2006.01)

(52) U.S. Cl. ..... 40/124.06; 40/124.12; 229/92.8

(58) Field of Classification Search ..... 40/124.06, 40/124.09, 124.11, 124.12; 229/68 R, 92.1, 229/92.8
See application file for complete search history.

(56) References Cited

U.S. PATENT DOCUMENTS 5,135,157 A 8/1992 Cruz
5,143,279 A 9/1992 Gaines
5,516,033 A 5/1996 Bernetich
5,575,384 A 11/1996 Saye
5,626,551 A 5/1997 Kearns et al.
5,641,115 A 6/1997 Brewster
5,645,214 A * 7/1997 Taganas ..... 229/313
5,845,425 A 12/1998 Leake et al.
5,862,979 A * 1/1999 Hill et al. ..... 229/92.1
5,946,834 A 9/1999 Bradley
6,070,719 A 6/2000 Pollock
D447,055 S 8/2001 Several et al.
D457,555 S 5/2002 Stephens-D'Angelo et al.
6,418,648 B1 7/2002 Hollingsworth et al.
6,457,638 B1 10/2002 Schmidt
6,491,213 B2 12/2002 Purcell
2003/0150142 A1 * 8/2003 Street ..... 40/124.11

* cited by examiner

*Primary Examiner*—Joanne Silbermann

(57) ABSTRACT

An envelope for one or more gift cards is disclosed.

18 Claims, 18 Drawing Sheets

(OPEN)

(OPEN)

(CLOSED)

(OPEN)

(OPEN)

(ADHESIVE LAYER EXPOSED)

(GIFTCARDS PLACED ON PANELS)

(SECOND PANEL FOLD)

(FIRST FOLD)

(FLAP FOLD)

(ADHESIVE STRIP EXPOSED)

(LEAVES FOLD)

(CLOSED)

(CLOSED)

(TEAR STRIPS REMOVED)

(GIFT CARD PRESENTATION)

(OPEN)

(CLOSED)

GIFT CARD ENVELOPE

CROSS REFERENCE TO RELATED APPLICATIONS

This application claims the priority of U.S. Provisional Application No. 60/436,721, filed on Dec. 24, 2002 and entitled "GIFT CARD ENVELOPE," which is hereby incorporated herein by reference:

BACKGROUND OF THE INVENTION

1. Field of the Invention

The present invention relates generally to implementations for presenting multiple gift cards. More particularly, the present invention relates to gift card envelopes that receive, hold and enclose two or more gift cards.

2. Description of the Related Art

Gift coupons refer to any certificate where the issuer has received payment for the full face value for the future purchase or delivery of goods or services and any medium that evidences the giving of consideration in exchange for the right to redeem it for goods, food, services, credit or money of at least an equal value. Gift coupons are typically given as gifts and may for example include gift certificates. Gift certificates are legal tender purchased by a buyer for use by a person other than the buyer and usable in its face amount in lieu of cash in exchange for goods or services supplied by the seller. Gift Certificates generally come in the form of a piece of paper with a designated amount or banked dollar value. The piece of paper also generally includes information about the seller of the gift certificate (e.g., logos, company name, etc.). The shape and look is typically similar to traditional money such as the dollar bill. The gift certificates may come in a particular dollar amount, or the gift certificates can be made to order, i.e., varying amounts may be applied to the gift certificate.

Gift Certificates have been around for some time. Gift certificates allow the holder of the certificate to purchase items using the gift certificate rather than using money. This particular format has been used with great regularity as a gift, especially when the buyer is not really sure what to give to someone such as a friend or family member. The gift certificate allows the purchaser to give a unique gift, but without having to actually find an item that would satisfy the recipient.

Gift coupons also include gift cards, which are the electronic equivalent of a gift certificate. They are similar to credit cards in makeup, however, they have a banked dollar value similar to gift certificates. Gift cards are typically formed from a plastic material that includes a magnetic strip thereon. The magnetic strip contains the dollar amount of the gift card. When used, the amount is reduced by the purchase price of the item being purchased. Like gift certificates, gift cards typically include information about the seller of the gift card (e.g., logos, company name, etc.).

In recent years, gift cards have become increasingly popular due to their ease of use. In fact, they have almost entirely replaced gift certificates. Gift cards are essentially credit cards with a designated limited. Gift cards may designate the amounts contained therein, or they may be programmable to any value. By way of example, gift cards may be purchased for amounts as low as $5 to as high as $1000 and beyond. The gift cards with pre designated amounts are typically packaged so that consumers may easily select their desired amount. In most cases, the plastic gift card is glued to a piece of cardboard backing. The cardboard backing includes a hole so that the gift card can hang from shelves. The card board backing also typically includes decoration or ornamentation such as a store logo.

Gift coupons such as gift certificates and gift cards are generally associated with particular store, i.e., the gift certificate or gift card can only be used at that store. Examples of stores include retail stores such as Wal Mart, Target, Best Buy, Circuit City, Macys, Sears and the like. Alternatively, the gift coupons may be issued by financial institutions such as bank or credit card companies. These coupons are generally accepted anywhere the institution is accepted, i.e., they act like a credit card. Visa, MasterCard and American Express are several examples of financial institutions that may issue these type of gift coupons.

In order to present the gift coupon as a gift, the gift coupon is typically placed in a pouch or envelope, both of which simulate gift wrap. The pouch or envelope is capable of receiving the gift certificate therein similar to money in a wallet. Unfortunately, however, there is generally a single pouch. This makes it difficult to present multiple gift coupons to the recipient. Furthermore, a gift coupon may be placed inside a greeting card. Greeting cards, however, do not typically include a means for holding the gift coupon thereto and thus the gift coupon may fall out when the greeting card is opened.

While gift coupons such as gift certificates and gift cards may be advantageous to the purchaser they can sometimes appear to be a thoughtless gift. That is, the recipient may think that the gift was bought in a hurry or because the purchaser didn't want to spend the time finding a physical gift.

SUMMARY OF THE INVENTION

The invention relates, in one embodiment, to a gift card presenter configured to present multiple gift cards or gift certificates to a recipient. The gift card presenter includes a panel having a plurality of gift card retaining mechanisms positioned on one or more sides of the panel. Each of the gift card retaining mechanisms is configured to removably attach a separate gift card to the panel. At least two of the gift card retaining mechanisms receives gift cards selected from different stores so as to form a shopping spree that is personalized to the recipient of the gift card presenter.

The invention relates, in another embodiment, to a gift card envelope configured to receive, hold and enclose one or more gift cards. The gift card envelope includes at least a first panel having a first gift card retaining mechanism for removably attaching a first gift card thereto and a second panel having a second gift card retaining mechanism for removably attaching a second gift card thereto. The second gift card represents a different store than the first gift card. The first and second panels are movable relative to one another so that the gift card envelope can be opened and closed. When opened, the gift cards when held by the gift card retaining mechanism are presented to a receiver of the gift card envelope. When closed, the gift cards when held by the gift card retaining mechanism are hidden from the receiver.

The invention relates, in another embodiment, to a gift card envelope. The gift card envelope includes a central panel having at least a pair of outer panels and flap extending therefrom. The panels and flap are formed from a single sheet of material. The outer panels and flap RE foldable relative to the central panel. the outer panels and flap generally fold in towards the central panel so as to close the gift card envelope. The panels and flap forms consecutive layers that overlap one another. Each of the panels includes a gift card retaining mechanism on its front side for removably attaching a different gift card. The flap includes a plurality of folding leaves. The folding leaves are configured to fold around the edges of the panels in order to close off any gaps found between the folded panels. The folding leaves provide a surface for attaching to the back side of the central panel. Each of the folding leaves includes a self adhesive strip and a tear strip. The self adhesive strip is positioned towards the outer edge of the folding leaves. The tear strip is positioned between the self adhesive strip and the folds that divide the folding leaves from the flap. The adhesive layer of the self adhesive strip is configured to form a permanent bond between the folding leaves and the backside of the central panel. The tear strip is provided to tear the folding leaves apart thereby releasing the flap from the back side of the central panel.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

Embodiments of the invention are discussed below with reference to FIGS. 1-16. However, those skilled in the art will readily appreciate that the detailed description given herein with respect to these figures is for explanatory purposes as the invention extends beyond these limited embodiments.

Figure 1:
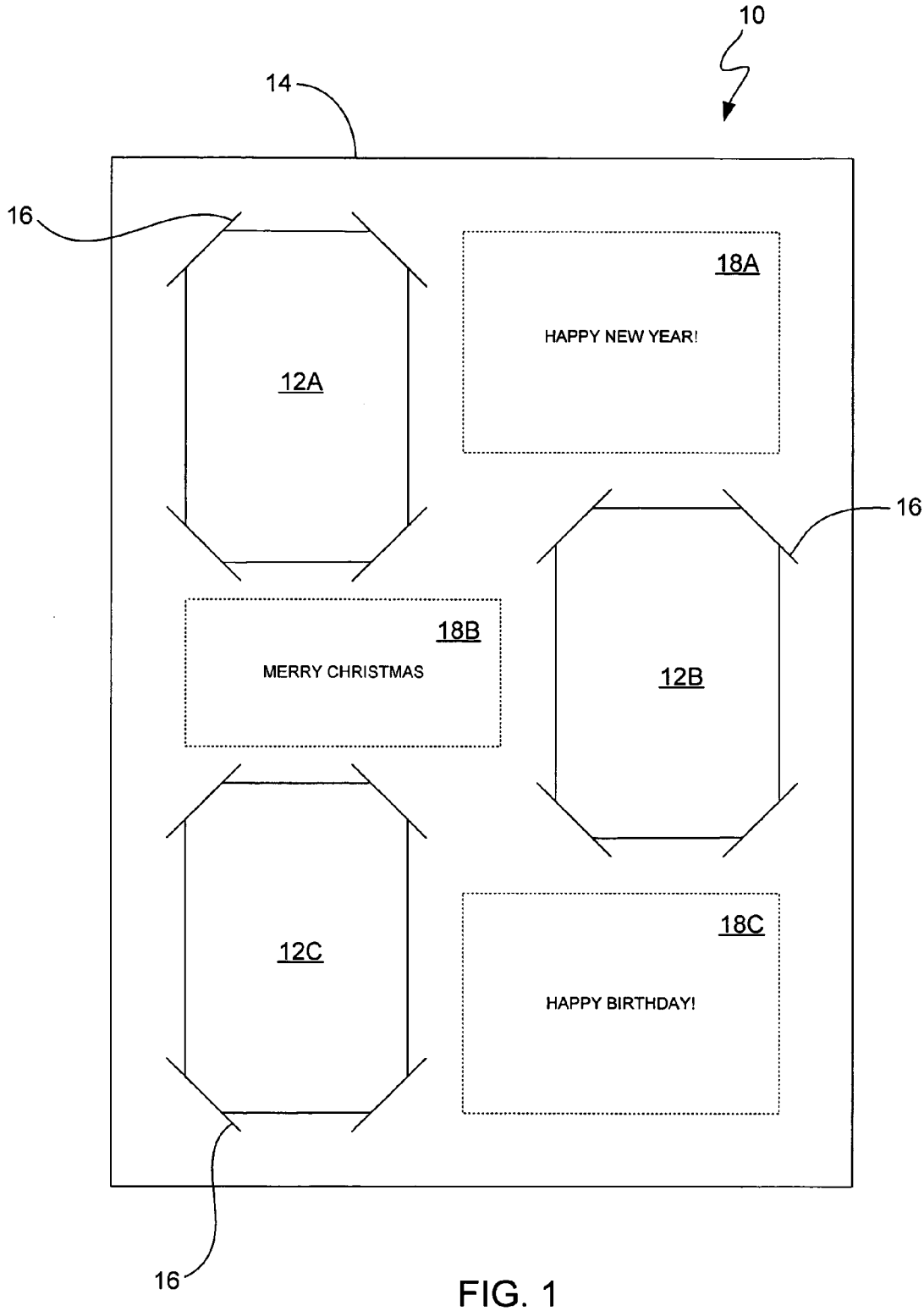
FIG. 1 is a front view diagram of a gift card presenter, in accordance with one embodiment of the present invention.

FIG. 1 is a front view diagram of a gift card presenter 10, in accordance with one embodiment of the present invention. The gift card presenter 10 is designed to present multiple gift cards and/or gift certificates 12 to a recipient. The multiple gift cards 12 can be selected from different stores thereby forming a shopping spree, which is personalized to the recipient of the gift card presenter 10. The gift card presenter 10 generally includes a panel 14 that may be formed from any suitable material. For example, it may be formed from sheets or films such as sheets of paper, cardboard, plastic, and the like. In the illustrated embodiment, the panel is formed from thin cardboard.

The gift card presenter 10 also generally includes a plurality of gift card retaining mechanisms 16 positioned on one or more sides of the panel 14. The gift card retaining mechanisms 16 are configured to removably attach the gift cards 12 to the panel 14, i.e., the gift card 12 is attached for presentation, however, it may be removed from the panel 14 so that it can be used by the receiver of the gift card presenter 10. The gift card retaining mechanisms 16 may be widely varied. For example, they may be selected from adhesives, glue, tape, pockets, picture corners, bands, slots, and the like. In the illustrated embodiment, the gift cards 12 are retained to the panel 14 via a plurality of slots that are cut into panel 14 (two or more). There is typically a slot located at each corner of the gift card 12, i.e., the corners of the gift card 12 slip into the slots thereby retaining the gift card 12 to the panel 14.

The gift card presenter 10 may also include one or more scribe regions 18 where information can be placed. By way of example, the information may be text or images that describe the relationship of the gift card to the recipient or provide a holiday greeting. The scribe regions 18 may be located on one or more sides of the panel 14. The scribe regions 18 may be preformed on the gift card presenter 10 by the manufacturer of the gift card presenter and/or they may be placed there by the giver of the gift card presenter 10. By way of example, the gift card presenter 10 may be bundled with software (e.g., graphics program) that allows the giver to personalize the scribe regions 18, as for example with a computer system that includes a printer.

Furthermore, once the gift cards 12 are attached to the panel 14, the gift card presenter 10 may be packaged within an envelope (or box) in order to hide the gift cards 12 when presented to the recipient. The envelope may be a separate component of the gift card presenter 10 or it may be integrally formed therewith. In the illustrated embodiment, the envelope is a separate component, i.e., the gift card presenter 10 is inserted into the envelope.

As mentioned above, multiple gift cards 12 can be selected from different stores thereby forming a shopping spree, which is personalized to the recipient of the gift card presenter 10. In one embodiment, the gift card presenter includes gift cards 12A-C from three different stores in order to provide a unique shopping experience to the recipient. Because there is more thought placed on this type of gift, the recipient holds the gift with higher regard, i.e., the gift giver did not just pick up a gift card as they left a store. Each of the gift cards includes its own scribe regions for relating the relevance of the gift card to the recipient. The arrangement of gift cards and thus the shopping spree may be widely varied. The shopping sprees may be configured for specific events. The specific events may for example correspond to vacations, graduations, house warmings, births, weddings, and the like.

Graduation shopping sprees may for example include a clothing store gift card, a shoe store gift card and an accessory store gift card so that the graduate may be prepared for interviews. Winter vacation shopping sprees may include a snow gear gift card, a ski rental gift card and a ski lift gift card. Summer vacation sprees may include sun glass store gift card, bathing suit store gift card and scuba gear rental gift card. House warming shopping sprees may include gift cards from hardware stores, nurseries, and furniture stores. Birth shopping sprees may include gift cards from toy stores, baby stores and grocery stores. Wedding shopping sprees may include gift cards from stores on the wedding registry.

Figure 2A:
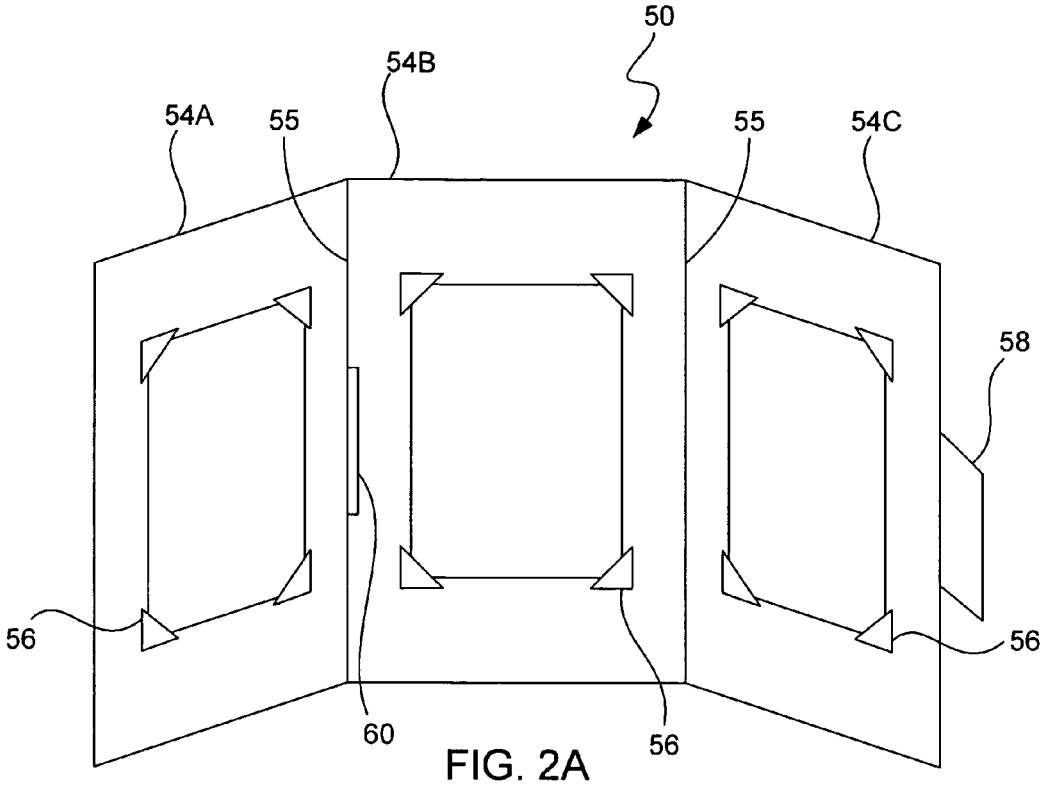
FIG. 2A is a perspective diagram of a gift card envelope in an open position, in accordance with one embodiment of the present invention.
Figure 2B:
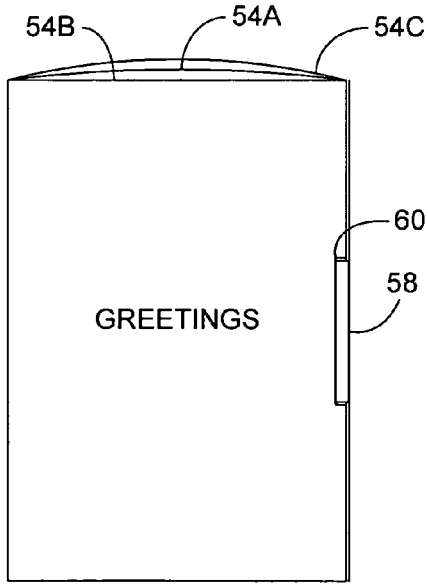
FIG. 2B is a perspective diagram of a gift card envelope in an closed position, in accordance with one embodiment of the present invention.
Figure 3A:
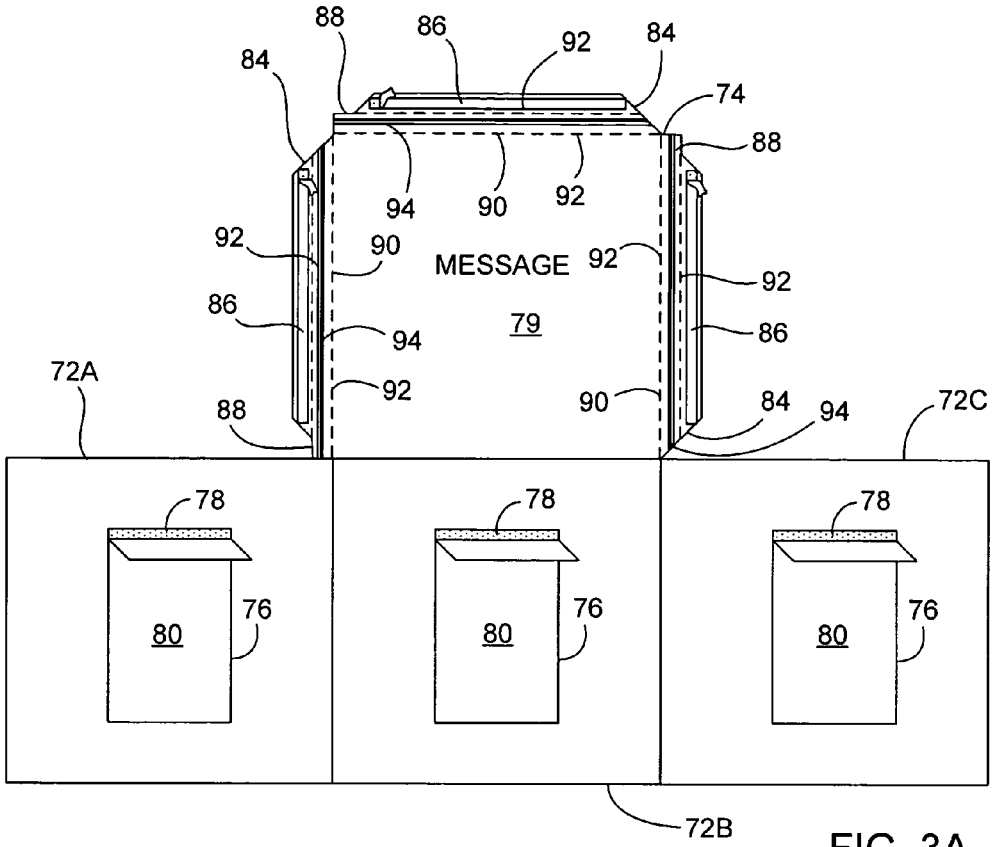
FIG. 3A is a front view diagram of a gift card envelope in a fully open position, in accordance with one embodiment of the present invention.
Figure 3B:
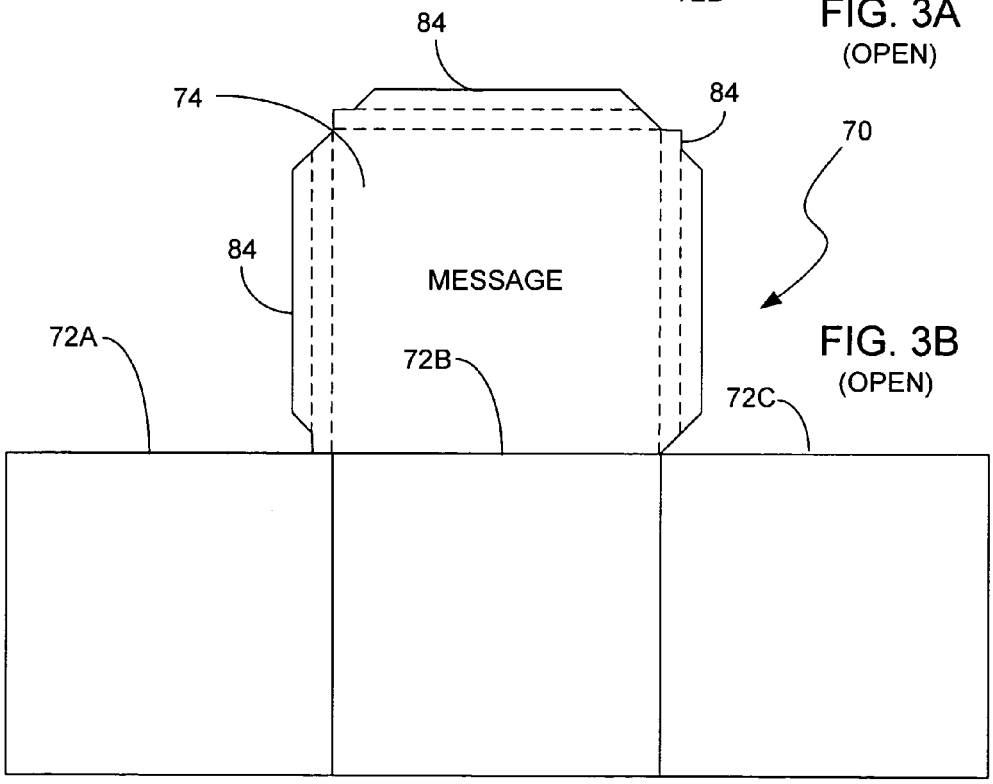
FIG. 3B is a rear view diagram of a gift card envelope of FIG. 3A in a fully open position, in accordance with one embodiment of the present invention.
Figure 3C:
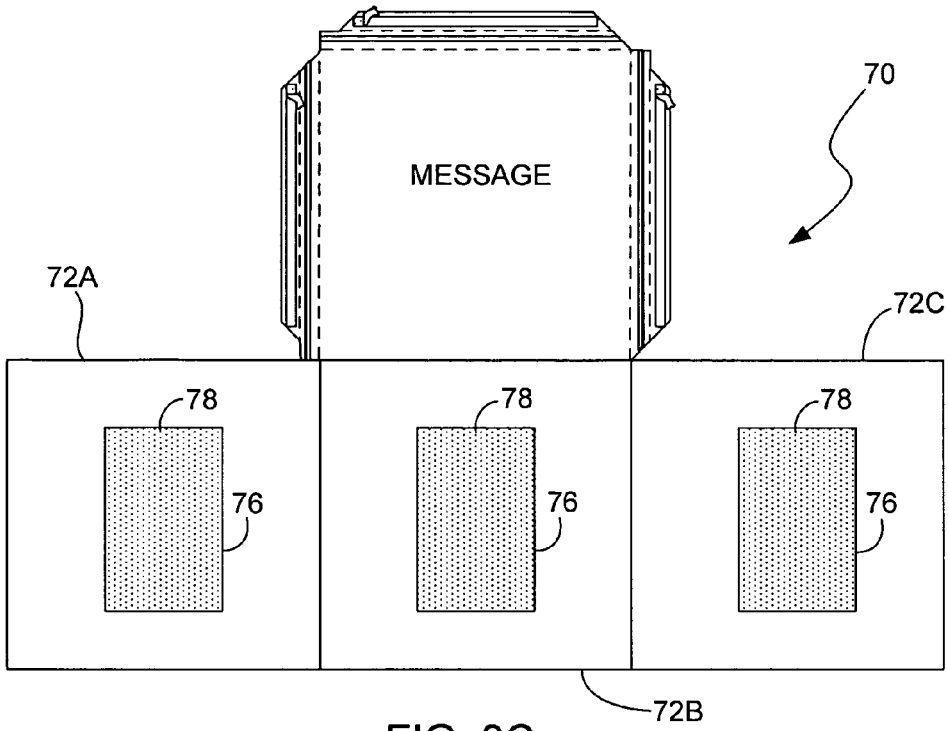
FIG. 3C is a front view diagram of a gift card envelope of FIG. 3A with an exposed adhesive layer, in accordance with one embodiment of the present invention.
Figure 3D:
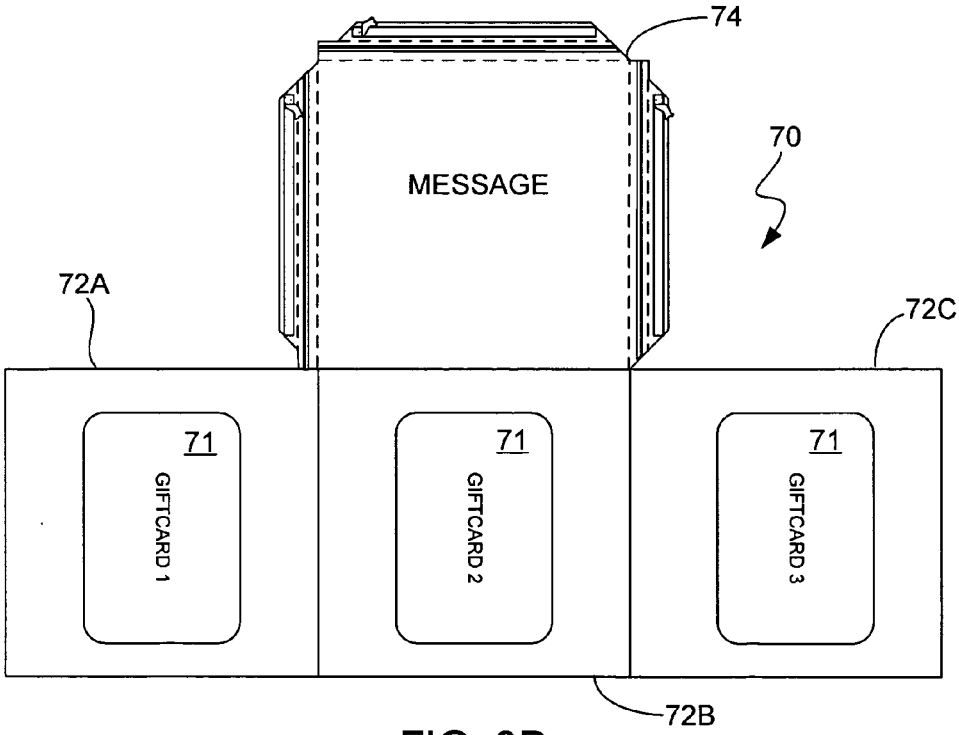
FIG. 3D is a front view diagram of a gift card envelope of FIG. 3A with gift cards attached to each of the panels, in accordance with one embodiment of the present invention.
Figure 3F:
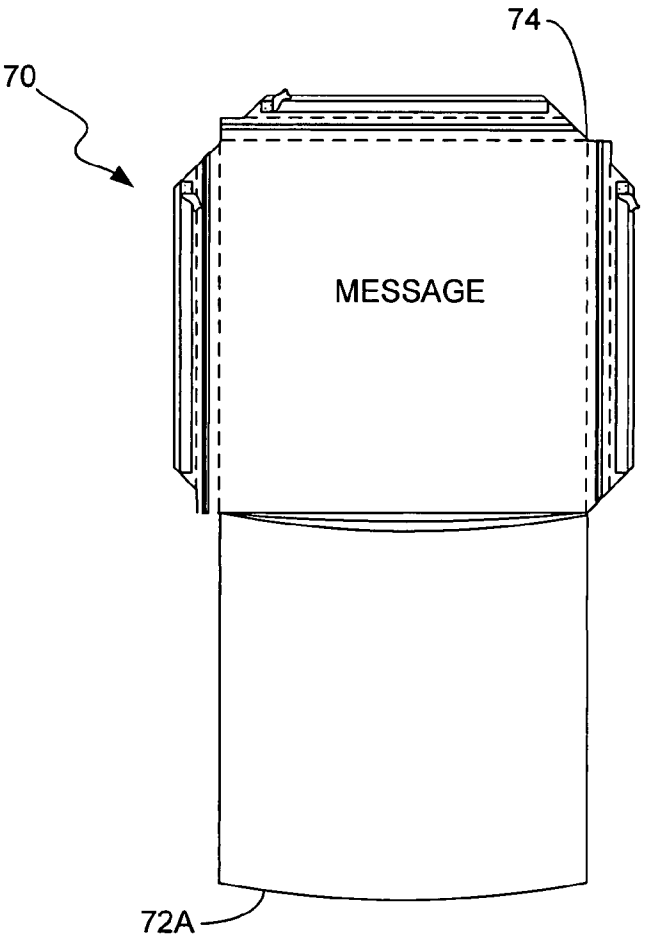
FIG. 3F is a front view diagram of a gift card envelope of FIG. 3A with a first outer panel folded over the central panel and a second outer panel folded over the first outer panel and central panel, in accordance with one embodiment of the present invention.
Figure 3E:
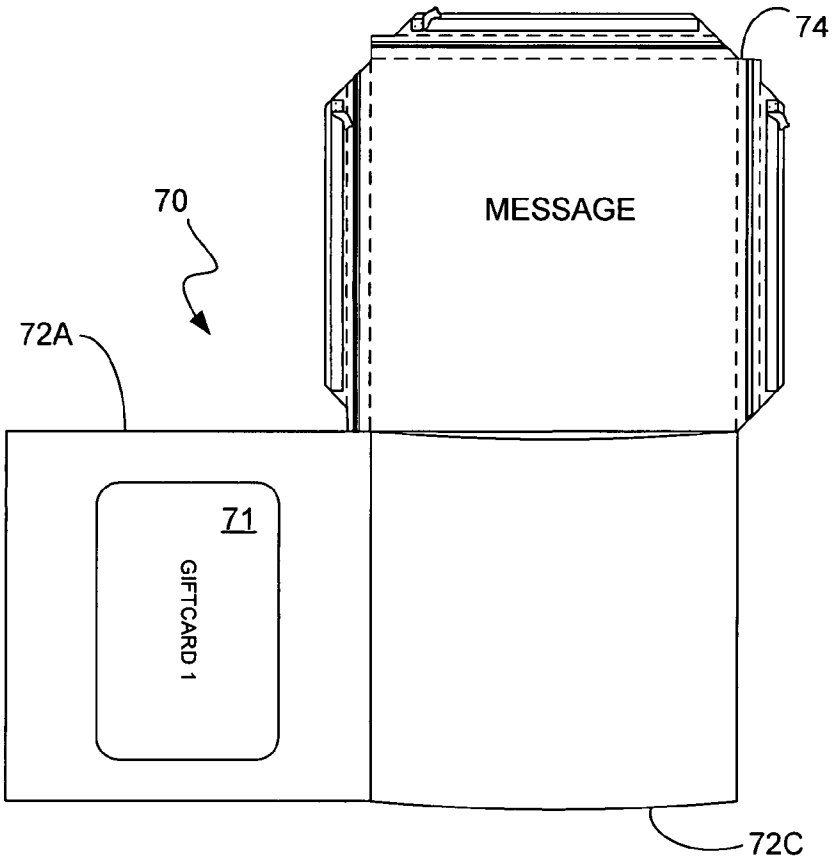
FIG. 3E is a front view diagram of a gift card envelope of FIG. 3A with a first outer panel folded over the central panel, in accordance with one embodiment of the present invention.
Figure 3G:
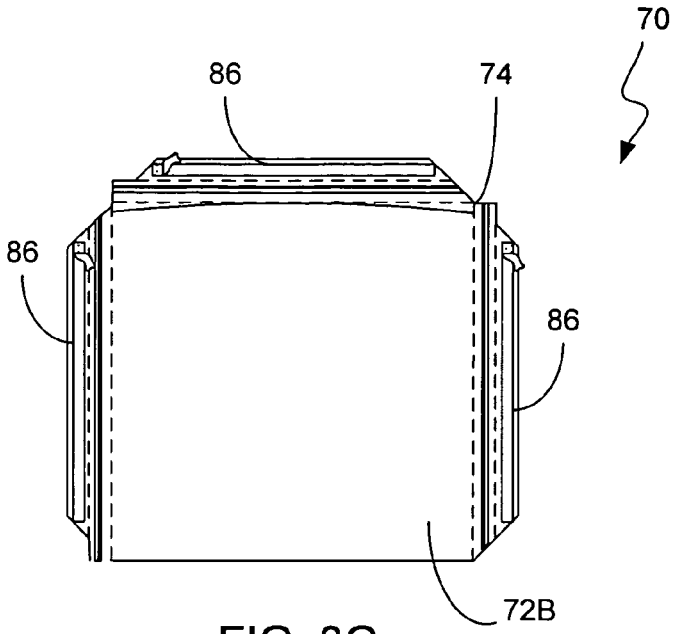
FIG. 3G is a rear view diagram of a gift card envelope of FIG. 3A with a first outer panel folded over the central panel, a second outer panel folded over the first outer panel and central panel, and a flap folded over the second and first outer panels as well as the central panel, in accordance with one embodiment of the present invention.
Figure 3H:
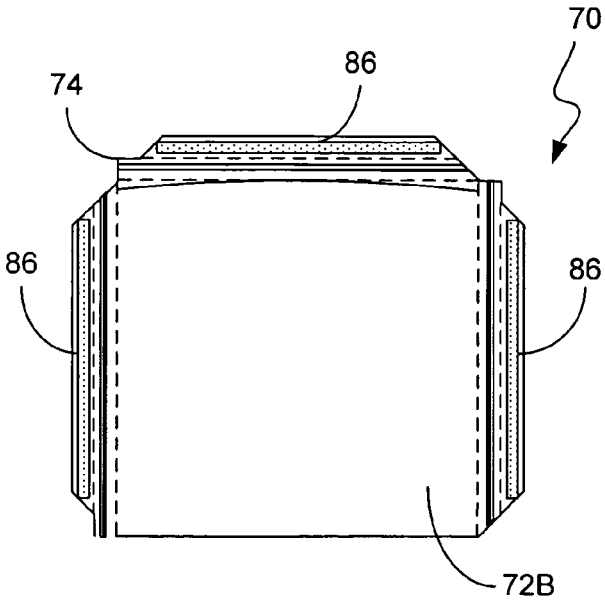
FIG. 3H is a rear view diagram of a gift card envelope of FIG. 3A with adhesive strips exposed, in accordance with one embodiment of the present invention.
Figure 3I:
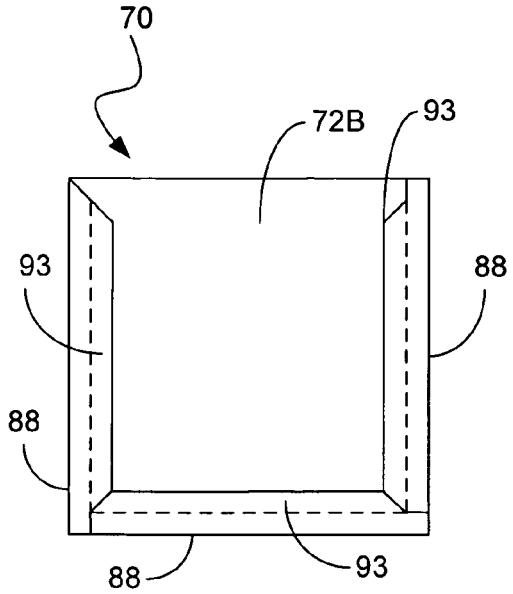
FIG. 3I is a rear view diagram of a gift card envelope of FIG. 3A with the folding leaves folded over the flap, in accordance with one embodiment of the present invention.
Figure 3J:
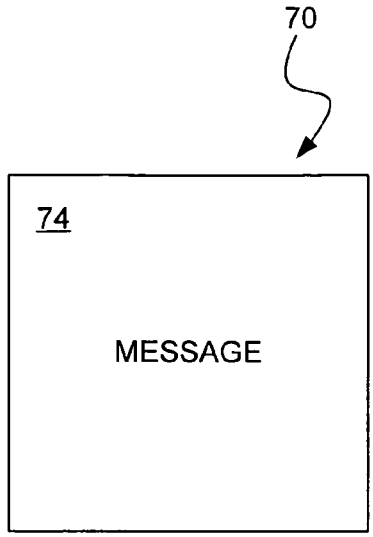
FIG. 3J is a front view diagram of a gift card envelope of FIG. 3A in its fully closed position, in accordance with one embodiment of the present invention.
Figure 3K:
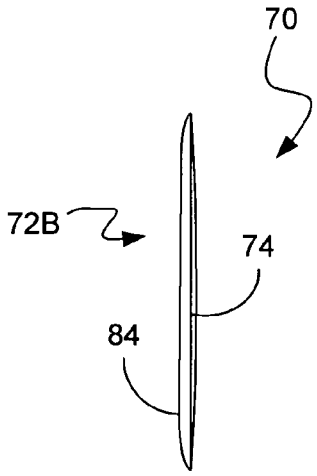
FIG. 3K is a side view diagram of a gift card envelope of FIG. 3A in its fully closed position, in accordance with one embodiment of the present invention.
Figure 3L:
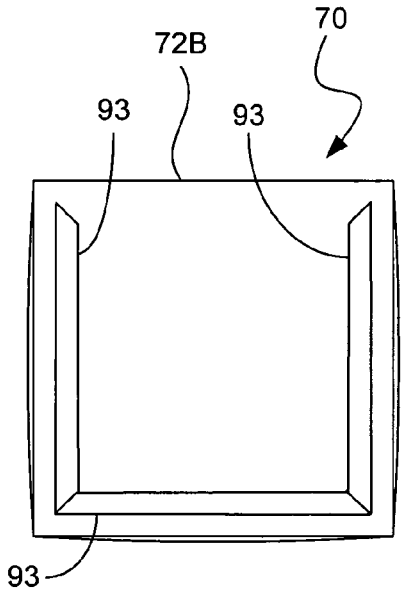
FIG. 3L is a rear view diagram of a gift card envelope of FIG. 3A in a fully closed position but with its adhesive strips attached and tear strips removed, in accordance with one embodiment of the present invention.
Figure 3M:
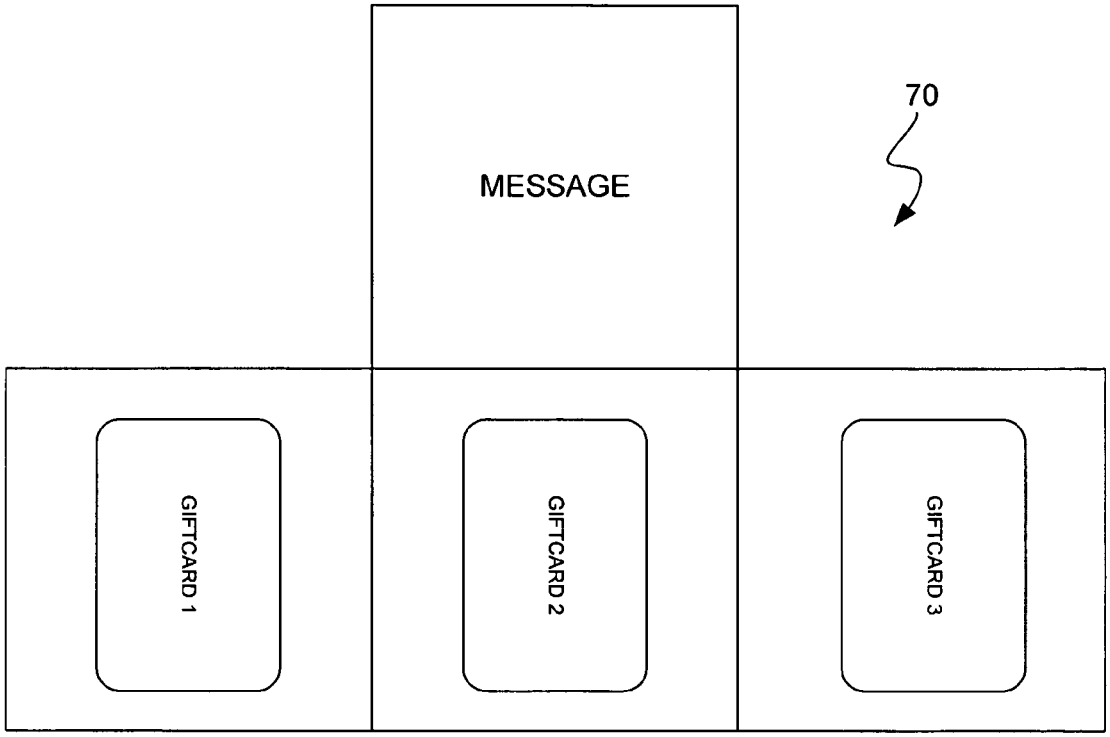
FIG. 3M is a front view diagram of a gift card envelope of FIG. 3A in a fully open position after the tear strips have been removed, in accordance with one embodiment of the present invention.

FIG. 2 is a perspective view diagram of a gift card envelope 50, in accordance with one embodiment of the present invention. The gift card envelope 50 is designed to receive, hold and enclose multiple gift cards 52 (or gift certificates). The material forming the gift card envelope 50 may be widely varied. It is generally formed from sheets or films of paper, cardboard, plastic, and the like. In the illustrated embodiment, the gift card envelope 50 is formed from thin cardboard. As shown, the gift card envelope 50 includes multiple panels 54, each of which includes a gift card 52 that is removably attached thereto, i.e., the gift card 52 is attached for presentation, however, it may be removed from the panel 54 so that it can be used by the receiver.

The panels 54 are generally connected to one another thereby forming a single structure. The panels 54 may be separate components that are attached or they may be integrally formed from a single component. Furthermore, at least a portion of the panels 54 are movable so that the gift card envelope 50 can be opened and closed. When opened, the gift cards 12 are presented to the receiver so that they can identify their gift (e.g., unwrapped). When closed, the gift cards 12 are hidden from the receiver so that they cannot identify their gift (e.g., wrapped). The movement of the panels 54 may be widely varied. For example, they may be configured to pivot, translate, rotate, etc. relative to one another. In the illustrated embodiment, at least a portion of the panels 54 pivot. The pivot may be provided by a hinge like component disposed between separate panels 54 or it may be provided by a fold between integrally formed panels 54. The hinge like component may for example be a ribbon that is glued to both sides of the panels 54.

In the illustrated embodiment, the panels 54 are formed from a single sheet and thus the pivoting movements are implemented through folds 55 that divide each of the panels 54. The configuration of the folds 55 and panels 54 may be widely varied. For example, the panels 54 may be positioned in a single direction or they may be positioned in multiple directions such as horizontal, vertical and/or diagonal. Furthermore, the folds 55 may cause the panels 54 to fold to either the front and/or back of the adjacent panel 54. The folds 55 may also cause the panels 54 to fold to the side, up or down and/or at an angle. The number of panels 54 may also be widely varied. The minimum number of panels 54 is typically two. The number generally depends on the number of gift cards 52 to be presented to the receiver.

In the illustrated embodiment, the gift card envelope 50 consists of three side by side panels 54A, 54B and 54C. The two outer panels 54A and 54C are configured to fold (or pivot) in towards the central panel 54B so as to close the gift card envelope 50. When closed, the panels 54A-C form consecutive layers that overlap one another. For example, the first outer panel 54A is folded over the center panel 54B and then the second outer panel 54C is folded over the first outer panel 54A, which is already positioned over the center panel 54B.

In most cases, each of the panels 54 includes a gift card retaining mechanism 56 for holding the gift card 52 thereto. The gift card retaining mechanisms 56 may be widely varied. For example, they may be selected from self adhesive strips, glue, double sided tape, pockets, picture corners, bands, slots or slits, and the like. In the illustrated embodiment, the gift cards 52 are retained to the panels 54 via picture corners 57. As should be appreciated, picture corners are typically used to mount photographs in pages of photo albums. The picture corners 57, which include recesses for receiving the corners of the gift cards 52, are typically attached to the front side of the panel 54. The picture corners may be attached using any suitable means as for example, adhesives or glues. Furthermore, each of the panels 54 may or may not include a scribe region as discussed above.

The gift card envelope 50 may also include an envelope holding mechanism 58 configured to keep the panels 54 in the closed position (e.g., folded) thereby hiding the gift cards 52 from the receiver of the gift card envelope 50. The envelope holding mechanism 58 is also configured to allow the panels 54 to be opened (e.g., unfolded) thereby presenting the gift cards 52 to the receiver of the gift card envelope 50. The envelope holding mechanism 58 may be widely varied. For example, it may be selected from tape, glue, self adhesive strips, tear strips, ribbons, inserts, stickers, labels, and the like. In the illustrated embodiment, the envelope holding mechanism 58 is an insert that extends from the edge of the outer panel 54C. The insert is insertable into a slot 60 located in the fold between the center panel 54B and the outer panel 54A when the last folded side panel 54C is closed over the center panel 54B. When inserted, the insert substantially holds the panels together in their closed position (e.g., like a loop and a belt). Additionally or alternatively, the gift card envelope 50 may be placed within a separate envelope (not shown).

Although not shown in FIG. 2, the gift card envelope 50 may also include one or more panels, flaps, leaves, etc. that do not retain gift cards 52 thereto. These panels may be used to cover the other panels, cover gaps between the other panels, or to provide a message on the gift card envelope 50.

FIGS. 3A-M are diagrams of a gift card envelope 70, in accordance with one embodiment of the present invention. The gift card envelope 70 is similar to the gift card envelope shown in FIG. 2. As shown, the gift card envelope 70 includes a plurality of side by side panels 72A-C and a flap 74 formed from a single sheet of material. The outer panels 72A and 72C, as well as the flap 74 are foldable with respect to the central panel 72B. That is, the two outer panels 72A, 72C and flap 74 are configured to fold (or pivot) in towards the central panel 72B so as to close the gift card envelope 70. When closed, the panels 72A-C and flap 74 form consecutive layers that overlap one another. For example, the first outer panel 72A is folded over the center panel 72B, then the second outer panel 72C is folded over the first outer panel 72A, which is already positioned over the center panel 72B, and thereafter the flap 74 is folded over the first and second outer panels 72A and 72C, which are already positioned over the center panel 72B.

Each of the panels 72 includes a self adhesive strip 76 for holding the gift card 52. The self adhesive strip 76 typically includes an adhesive layer 78, which is applied to the panels 72 and a strip 80, which is disposed over the adhesive layer 78. The adhesive layer 78 is configured for temporarily bonding a gift card 71 to the panel 72 when the strip 80 is removed and the gift card is laid thereover and the strip 80 is configured for protecting the adhesive layer 78 when the adhesive layer 78 is not in use. By way of example, the adhesive layer 78 may be glue, which is sprayed onto the surface of the panel 72, and the strip 80 may be a sheet of material that does not bond very well with the adhesive layer (e.g., wax paper). As should be appreciated, in order to position the gift cards on the panels 72, the card giver pulls off the strips 80 and places the card on the adhesive layer 78. When placed on the adhesive layer 78, the gift card forms a bond with the adhesive layer 78 thereby retaining the gift card 71 to the panel 72. The bond is generally strong enough to prevent the gift card 71 from falling off the panel, but not strong enough to permanently mount the gift card 71 to the panel or to alter the gift card 71 in a non trivial manner.

The flap 74, on the other hand, may include a scribe region 79 (e.g., message) for placing a message or it may include another adhesive strip for receiving another gift card. In the illustrated embodiment, the flap includes a scribe region. The scribe region may include a prepared message or it may provide a space for placing a personal message. By way of example, the scribe region may state something like "Happy Holidays," "Best Wishes for the New Year" or "Happy Birthday." A scribe region may also be placed on the exterior or back side of the flap or panels.

As shown, each flap 74 includes a plurality of folding leaves 84. The folding leaves 84 are configured to fold around the edges of the stacked panels 72 and flap 74 in order to close off any gaps found between the panels 72 when in the closed position. The leaves 84 also provide a surface for attaching to the backside of the central panel 72B so as to keep the folded panels in the closed position. Any suitable attachment means may be used. For example, the leaves 84 may be glued or taped to the back side of the central panel 72B.

In the illustrated embodiment, each of the folding leaves 84 includes an adhesive strip 86 and a tear strip 88. The adhesive strip 86 is positioned towards the edge of the leaves 84 and the tear strip 88 is positioned between the folds 90 that divide the flap 74 and the adhesive strip 86. The adhesive strip 86 is similar to the adhesive strip described above. In this case, however, the adhesive layer is configured to form a permanent bond between the leaves 84 and the backside of the central panel 72B. The tear strip 88 is provided to release the leaves from this permanent bond. The tear strip is a place on the leave that may be torn away in order to split the leave substantially along the folds 90. The tear strip 88 is generally formed by one or two perforated lines 92. In order to break the connection between the flap 74 and the central panel 72B, the tear strip 88 is torn away from the leaves 84 thereby forming a gap between the fold 90 and the bonded portion 93 of the leaves 84, The tear strip 88 typically includes a pull member 94 that doesn't break when pulled thereby keeping the strip breaking along perforated lines 92. By way of example, the pull member 94 may include string, ribbon, wires, fabric or other similar material.

Figure 4:
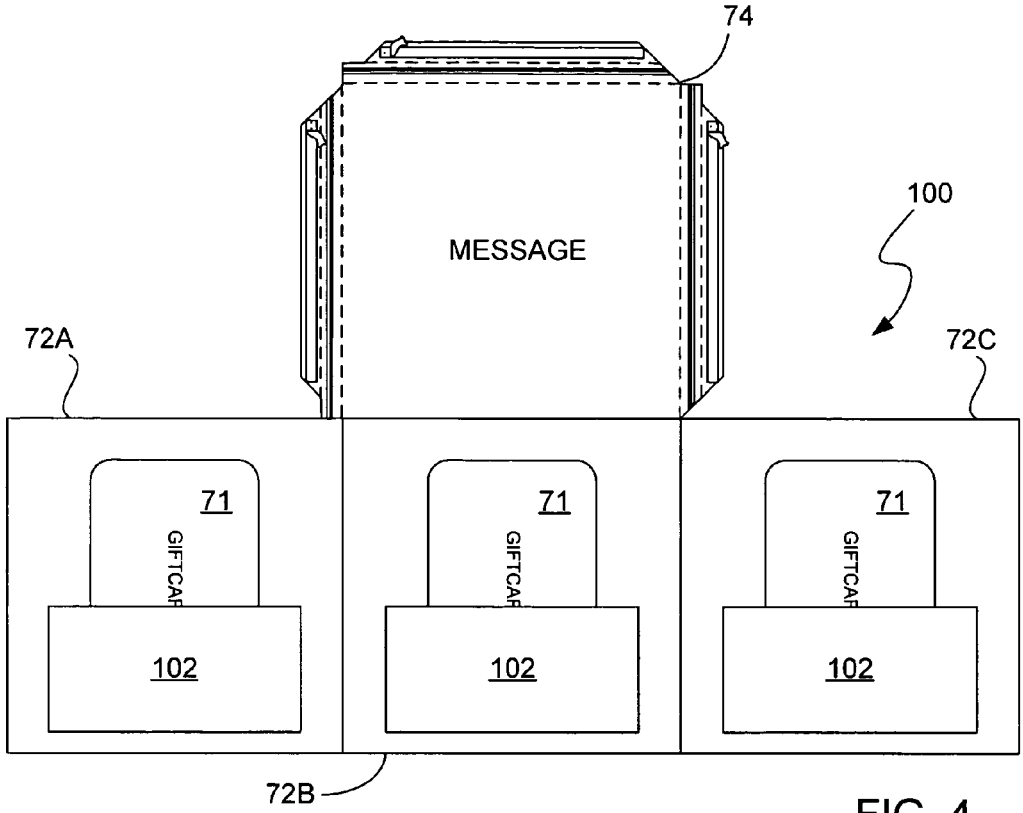
FIG. 4 is a front view diagram of a gift card envelope with pockets, in accordance with one embodiment of the present invention.

FIG. 4 is a front view diagram of a gift card envelope 100, in accordance with another embodiment of the present invention. The gift card envelope 100 is similar to the gift card envelope 70 shown in FIG. 3, however unlike the gift card envelope 70 shown in FIG. 3, the gift card envelope includes pockets 102 for retaining the gift card to the panels 72 (rather than adhesive strips). The pockets 102 provide a cavity or pouch for placing the gift cards 71. The pockets 102 are generally dimension for receiving at least a portion of the gift card 71 therein. In most cases, the pockets 102 cover a small portion of the gift card 71 (bottom half) so that the gift card 71 is visible to the receiver of the gift card envelope 100. The pockets 102 may be integrally formed with the panels 72 (e.g., folded portion) or they may be a separate component that is mounted to the panel 72. When integrally formed, the pocket may be created by folding a tab located at the bottom of the panel and gluing its sides to the panel 72. In the illustrated embodiment, the pocket 102 is a separate component that is mounted to the panel. Any suitably mounting means may be used. For example, glue or double stick tape may be used. Pockets may be used to retain gift certificates.

Figure 5:
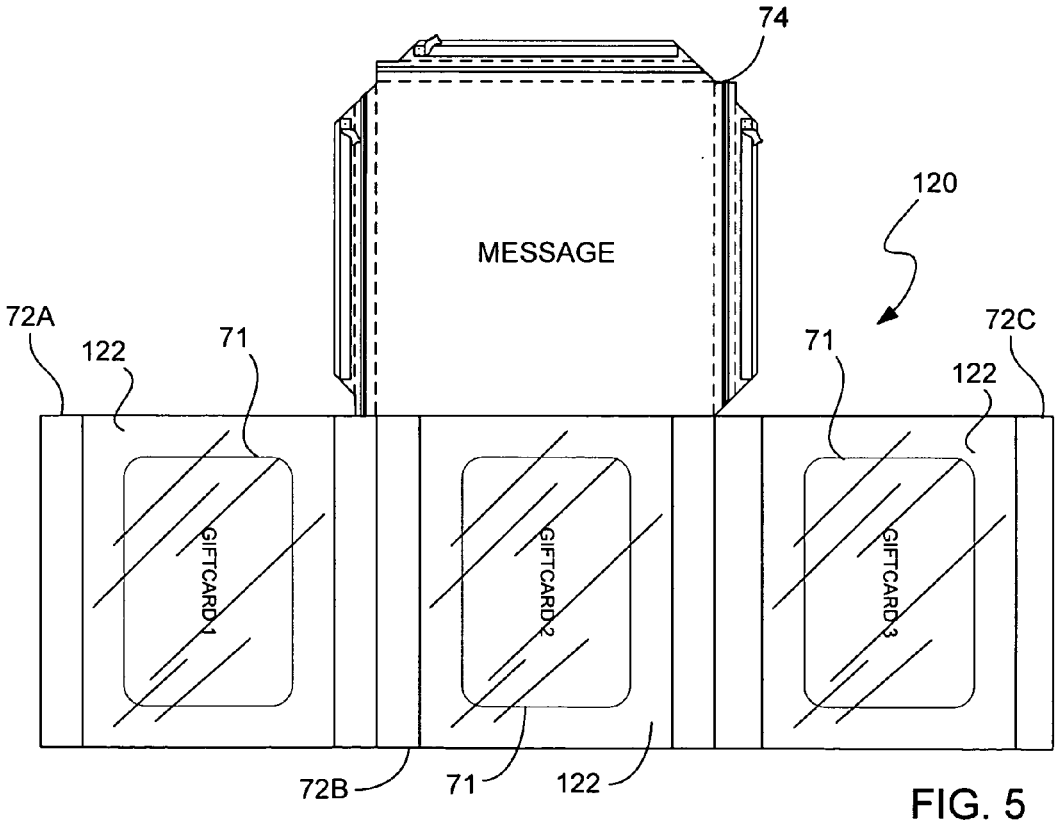
FIG. 5 is a front view diagram of a gift card envelope window pockets, in accordance with one embodiment of the present invention.

FIG. 5 is a front view diagram of a gift card envelope 120, in accordance with another embodiment of the present invention. The gift card envelope 100 is similar to the gift card envelope 70 shown in FIG. 3, however unlike the gift card envelope 70 shown in FIG. 3, the gift card envelope 120 includes window pockets 122 for retaining the gift card 71 to the panels 72 rather than adhesive strips. The window pockets 122 are formed from a clear material so that the entire gift card 71 may be seen. For example, the window pocket may be formed from thin plastic films such as Mylar, cellophane, etc. The window pockets 122 generally include a slit 124 for placing the gift card 71 therein. The slit 124 may for example be positioned on the side of the window pocket (as shown) or on the top of the window pocket 122. The window pocket 122 is generally dimension for receiving the entire gift card 71 therein.

Figure 6:
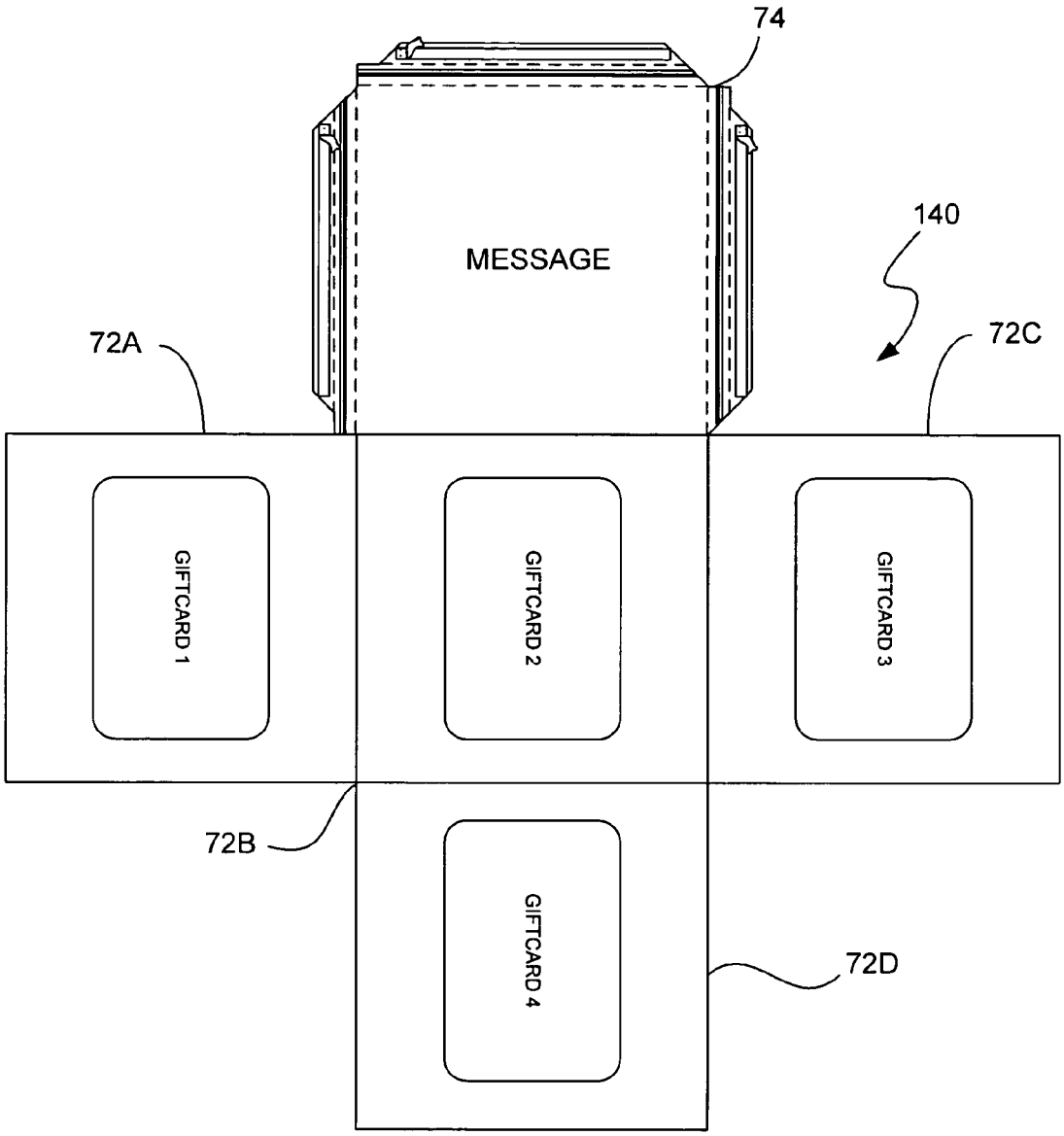
FIG. 6 is a front view diagram of a gift card envelope with extra panels, in accordance with one embodiment of the present invention.

FIG. 6 is a front view diagram of a gift card envelope 140, in accordance with another embodiment of the present invention. The gift card envelope 100 is similar to the gift card envelope 70 shown in FIG. 3, however unlike the gift card envelope 70 shown in FIG. 3, the gift card envelope 140 includes another panel 72D. The panel 72D may include a scribe region for placing a message or it may include another adhesive strip for receiving another gift card. In the illustrated embodiment, the extra panel 72D includes an adhesive strip for receiving another gift card 71.

Figure 7:
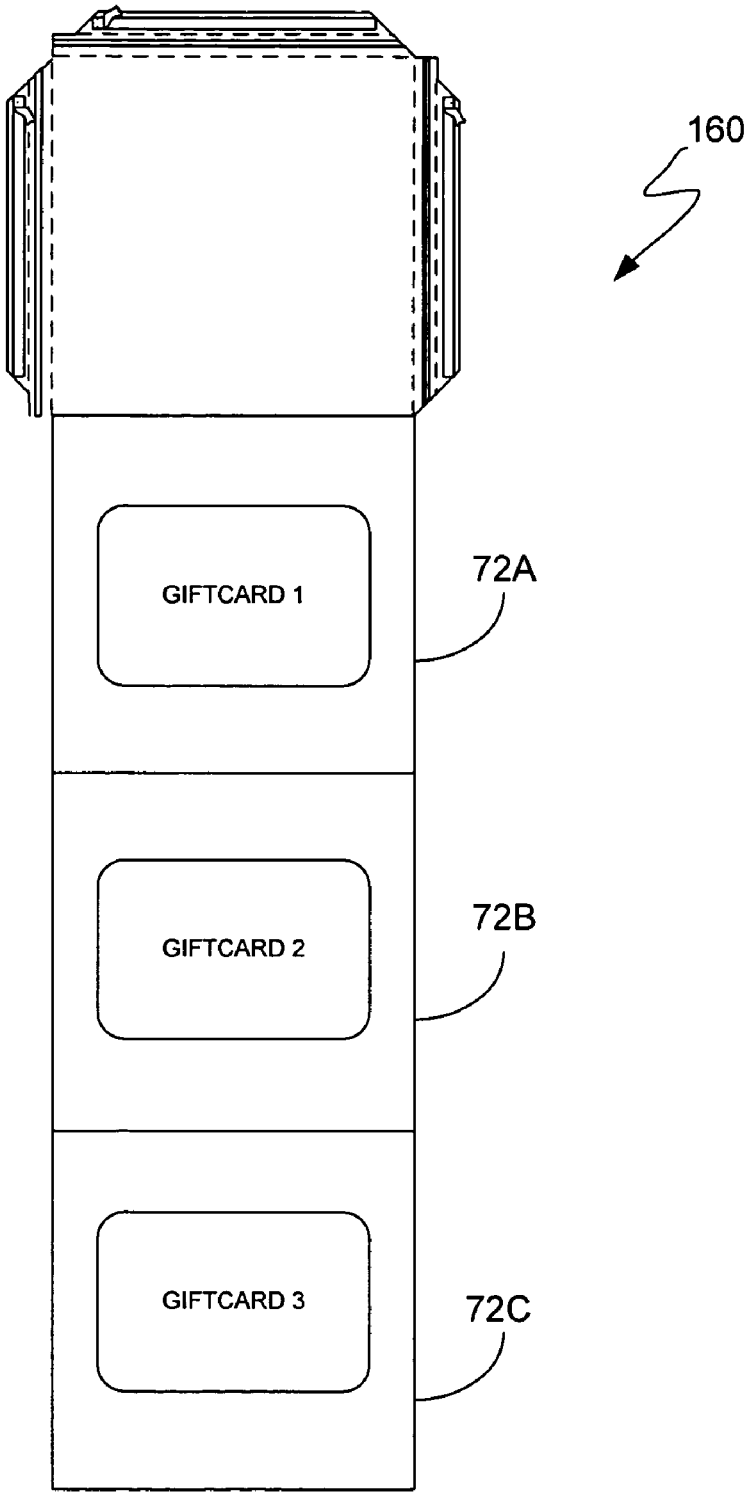
FIG. 7 is a front view diagram of a gift card envelope with vertical positioned panels, in accordance with one embodiment of the present invention.

FIG. 7 is a front view diagram of a gift card envelope 160, in accordance with another embodiment of the present invention. The gift card envelope 100 is similar to the gift card envelope 70 shown in FIG. 3, however unlike the gift card envelope 70 shown in FIG. 3, the gift card envelope 160 includes panels positioned vertically rather than horizontally. Each adjacent panel 72A-C can be folded onto the next adjacent panel.

Figure 8:
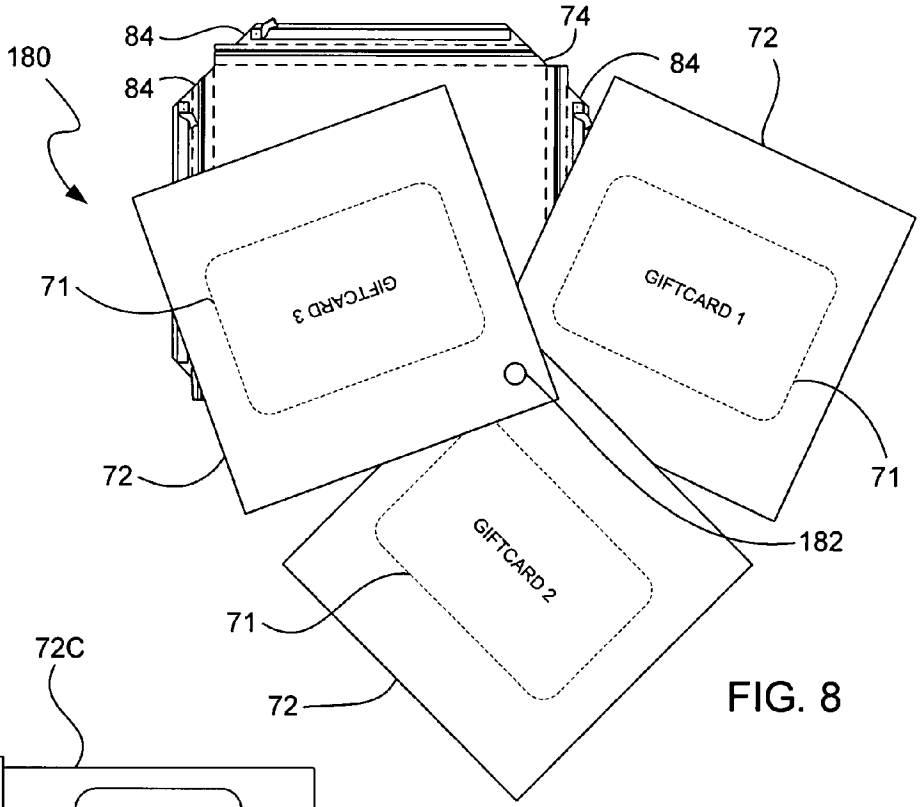
FIG. 8 is a front view diagram of a gift card envelope with rotating panels, in accordance with one embodiment of the present invention.

FIG. 8 is a front view diagram of a gift card envelope 180, in accordance with one embodiment of the present invention. In this particular embodiment, the envelope 180 includes a plurality of panels 72A-C that are rotatable relative to one another via axis 182. The axis may be provided by any suitable method as for example, shoulder bolts, pins, grommets and the like. The panel 72A-C can rotate over one another so that they overlap and thus the leaves may be used as described previously. In order to fully enclose the gift cards 71, the gift cards 71 are typically attached to the interior portion of the panel as shown by the dotted lines. The leaves 84 can therefore wrap around all the edges of the panel to seal the envelope 180 in accordance with the previous embodiments. Unlike the previous embodiments, however, the flap 74 may need a leaf 84 at each side rather than just on three sides. Alternatively, the gift card envelope may include a second flap that sandwiches the panels between itself and the first panel 84. The second flap may extend from the bottom of the first flap 84.

In one particular embodiment, the axis is formed by a pin that extends through holes in the panels 72. The pin may include flanges at each of its ends. The first flange is attached to the inner surface of the flap 84. The second flange serves to hold panels 72 on the pin. In one example, the panels 72 are forced over the second flange in order to place the panels 72 around the pin disposed between the flanges (the flanges movably retain the panels on the pin). The pin including its flanges is typically very shallow so as not to add depth to the gift card envelope 180.

Figure 9:
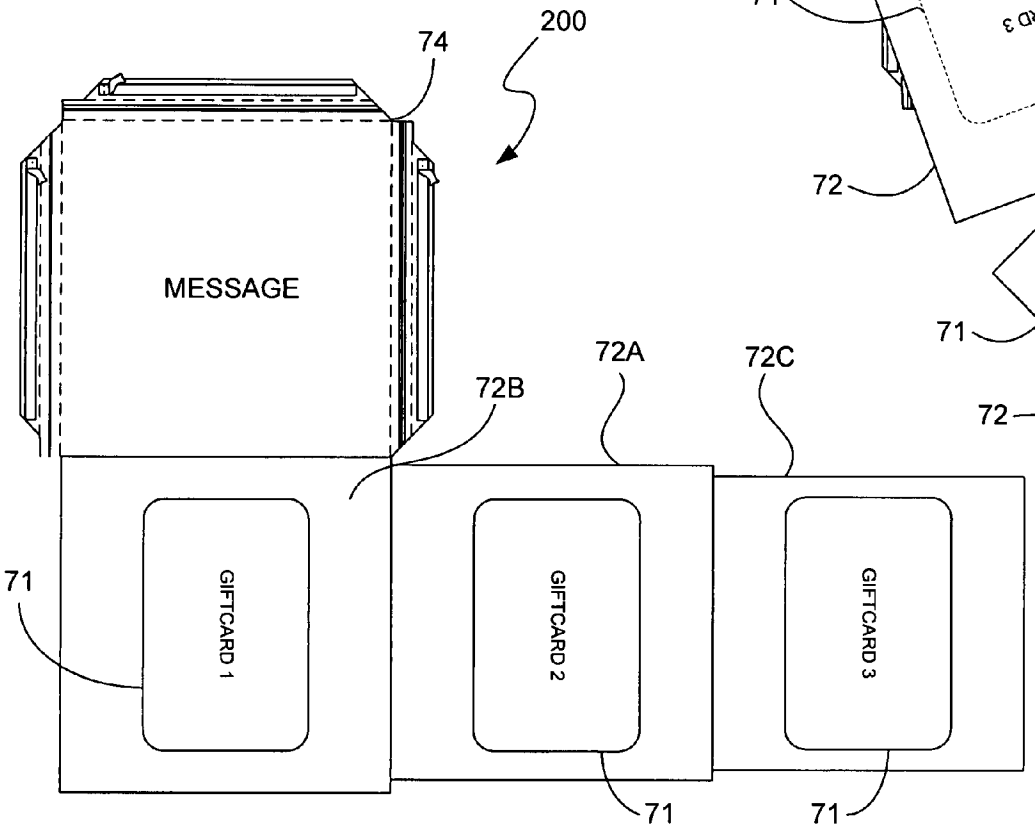
FIG. 9 is a front view diagram of a gift card envelope with translating panels, in accordance with one embodiment of the present invention.
Figure 10:
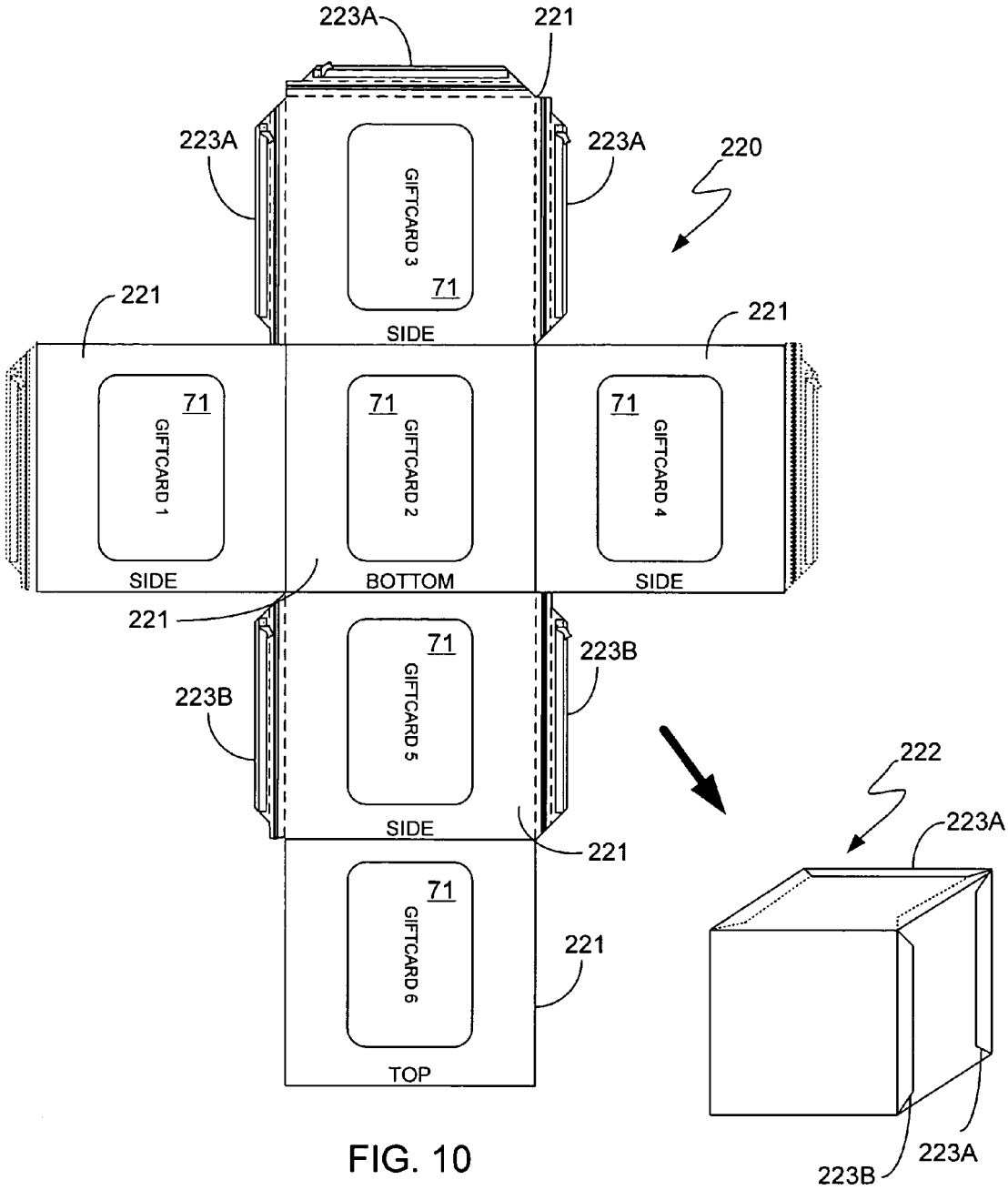
FIG. 10 is a front view diagram of a gift card envelope and its corresponding gift box formed therefrom, in accordance with one embodiment of the present invention.

FIG. 9 is a front view diagram of a gift card envelope 200, in accordance with one embodiment of the present invention. In this particular embodiment, the envelope 200 includes a plurality of panels 72*a-c* that translate relative to one another. By way of example, they may telescope. In order to accomplish this particular embodiment, the central panel 72B may include a panel receiving channel that slidably receives the first outer panel 72A. The first outer panel 72A includes a panel receiving channel that slidably receives the second outer panel 72C. The panel receiving channel may for example correspond to a sleeve having a slit through which each translating panel is located before being pulled out in the telescoping manner FIG. 10 is a front view diagram of a gift card envelope 220, in accordance with one embodiment of the present invention. In this particular embodiment, the panels 221 can be folded into a box 222 or some other three dimensional shape such as a pyramid. The gift cards 71 are thereby hidden within the box 222. In the illustrated embodiment, each panel corresponds to a side of the box 222. As a result there are 6 panels, as 6 sides make a box. In order to fully enclose the box 22, i.e., eliminate gaps at the edges, some of the panels 221 include folding leaves 223, which may generally correspond the folding leaves 84 shown in FIG. 3. In this particular embodiment, opposing sides of the box 222 include the folding leaves 223. A first opposing side includes three folding leaves 223A, and the other opposing side includes a pair of folding leaves 223B. Although this configuration works well, it should be noted that it is not a limitation and that the folding leaves may be positioned on other panels.

Figure 11:
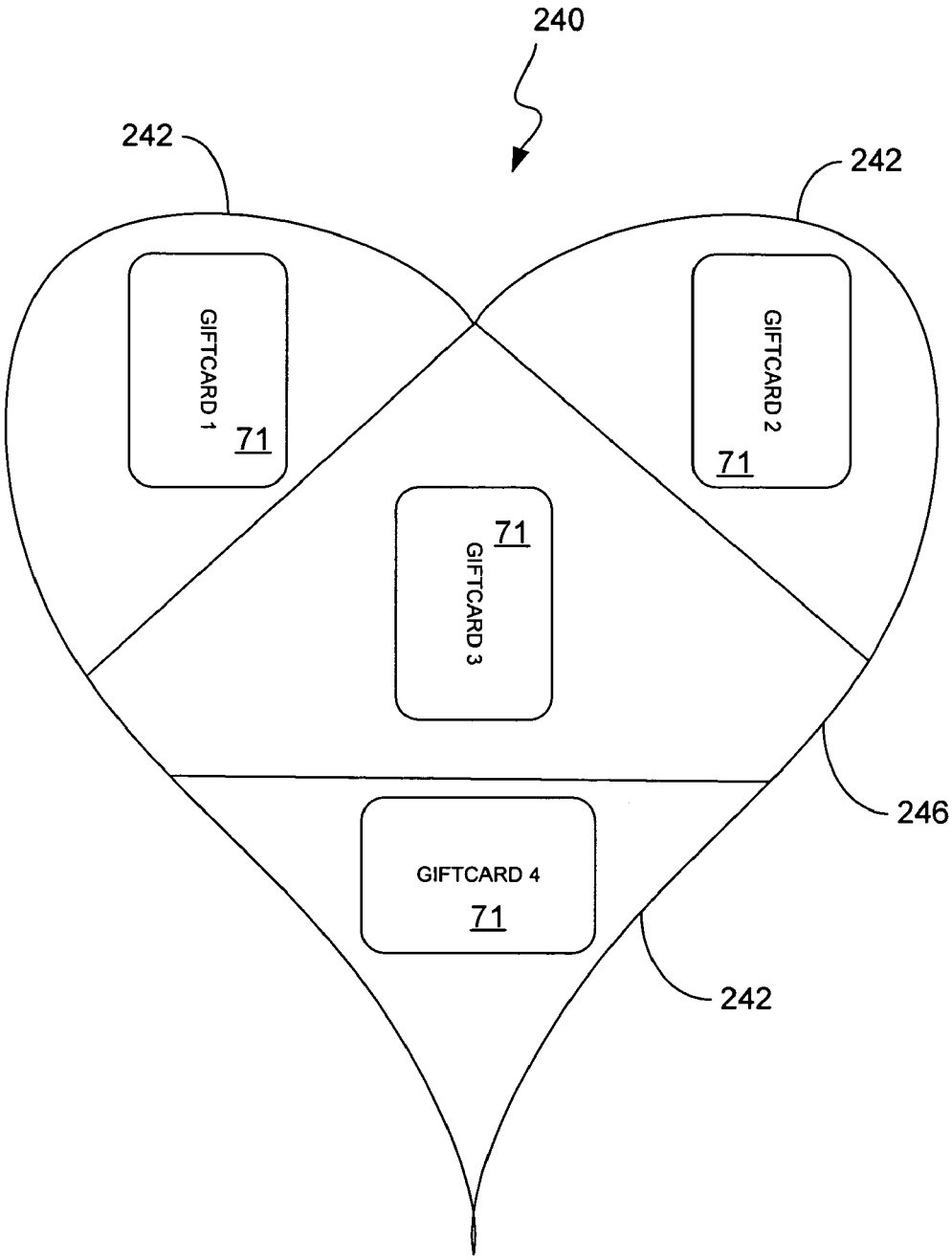
FIG. 11 is a front view diagram of a heart shaped gift card envelope, in accordance with one embodiment of the present invention.

FIG. 11 is a front view diagram of a gift card envelope 240, in accordance with one embodiment of the present invention. In this particular embodiment, the envelope 240 is configured to form a shape such as a heart. The panels 242, which extend from a central member 246 are located at the humps of the heart as well as the point of the heart. The hump panels 242 fold in towards the pointed portion 242 of the heart and the pointed portion 242 folds in towards the humps panels 242.

Figure 12A:
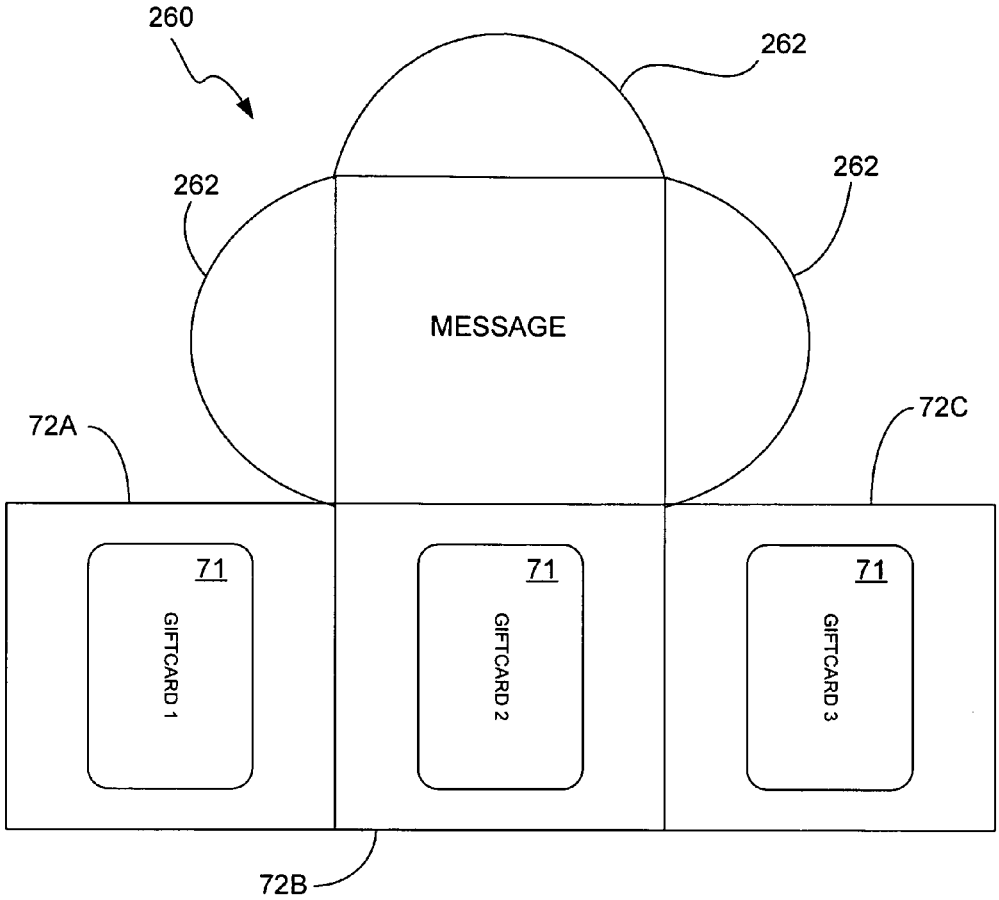
FIG. 12A is a front view diagram of a gift card envelope in an open position, in accordance with one embodiment of the present invention.
Figure 12B:
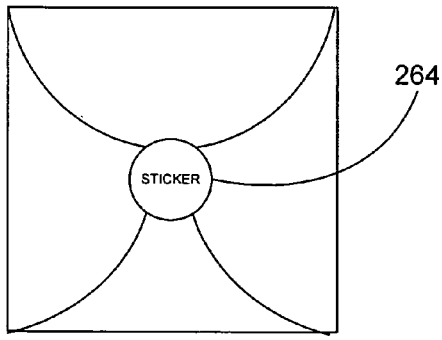
FIG. 12B is a rear view diagram of a gift card envelope of FIG. 12A in a closed position, in accordance with one embodiment of the present invention.

FIGS. 12A and 12B are diagrams of a gift card envelope 260, in accordance with one embodiment of the present invention. In this particular embodiment, the leaves 262 are configured to extend farther away than the leaves shown in FIG. 3. The leaves 262 also have a different shape. The leaves 262 may be attached to the backside using a sticker 264 as shown in FIG. 12B.

The gift card envelopes may further be configured to include pop up capabilities. When the gift card is opened, the pop up causes the gift cards to fold out towards the recipient of the gift card when the panels are moved from the closed to open position. That is, the gift cards are biased to move outwards so that they are better presented to the recipient.

Figure 13A:
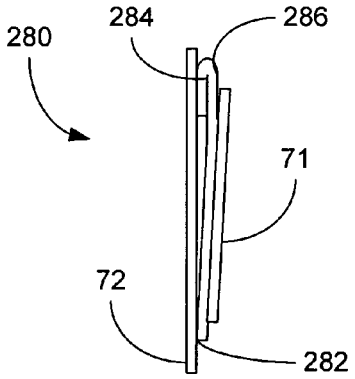
FIG. 13A is a side view diagram, in cross section, of a gift card envelope after assembly, in accordance with one embodiment of the present invention.
Figure 13B:
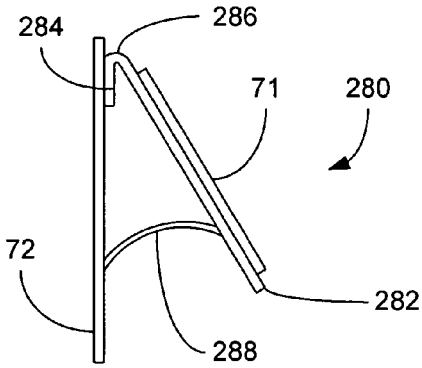
FIG. 13B is a side view diagram, in cross section, of a gift card envelope of FIG. 13A after disassembly, in accordance with one embodiment of the present invention.

FIGS. 13A and 13B are side views of a gift card envelope 280 including a pop up mechanism, in accordance with one embodiment of the present invention The pop up mechanism is configured to force the gift card 71 from a packaged position (as shown in FIG. 13A) to a presented position (as shown in FIG. 13B). When in the packaged position, the sealed panels 72 keep the gift card retained therein. When the seal has been broken, the gift card 71 springs into the presented position. As shown in FIG. 13B, the gift card 71 is attached to a gift card support member 282 that pivots relative to a panel 72. The pivot may for example be formed from a fold. The gift card support member 282 may be integrally from the same sheet as the panels 72 or they may be separate components that are attached to the panels 72. For example, as shown, the gift card support member 282 may include an attachment area 284 that is glued to the panel 72 and a fold 286 for allowing the gift card support member 282 to pivot relative to the panel 72. The gift card support member 282 is preferably spring biased so that the gift card 71 springs out when the panels 72 are unsealed or opened. In fact, the spring action may force the panels 72 to swing open when the seal is broken (leaves 84). The spring bias may be provided into the support member 282 itself (e.g., flexure) or from a biasing element 288. The biasing element may for example be a flexure that pushes the support member 282 outward.

The gift card envelopes may further be configured to include pull out capabilities. The pull outs generally slide between an open and closed position. When closed, the gift cards are hidden from view even when the gift card envelope is opened. When opened, the gift cards are presented to the receiver. In essence, the pull outs act like doors that cover the gift cards until they are ready to be seen by the recipient.

Figure 14:
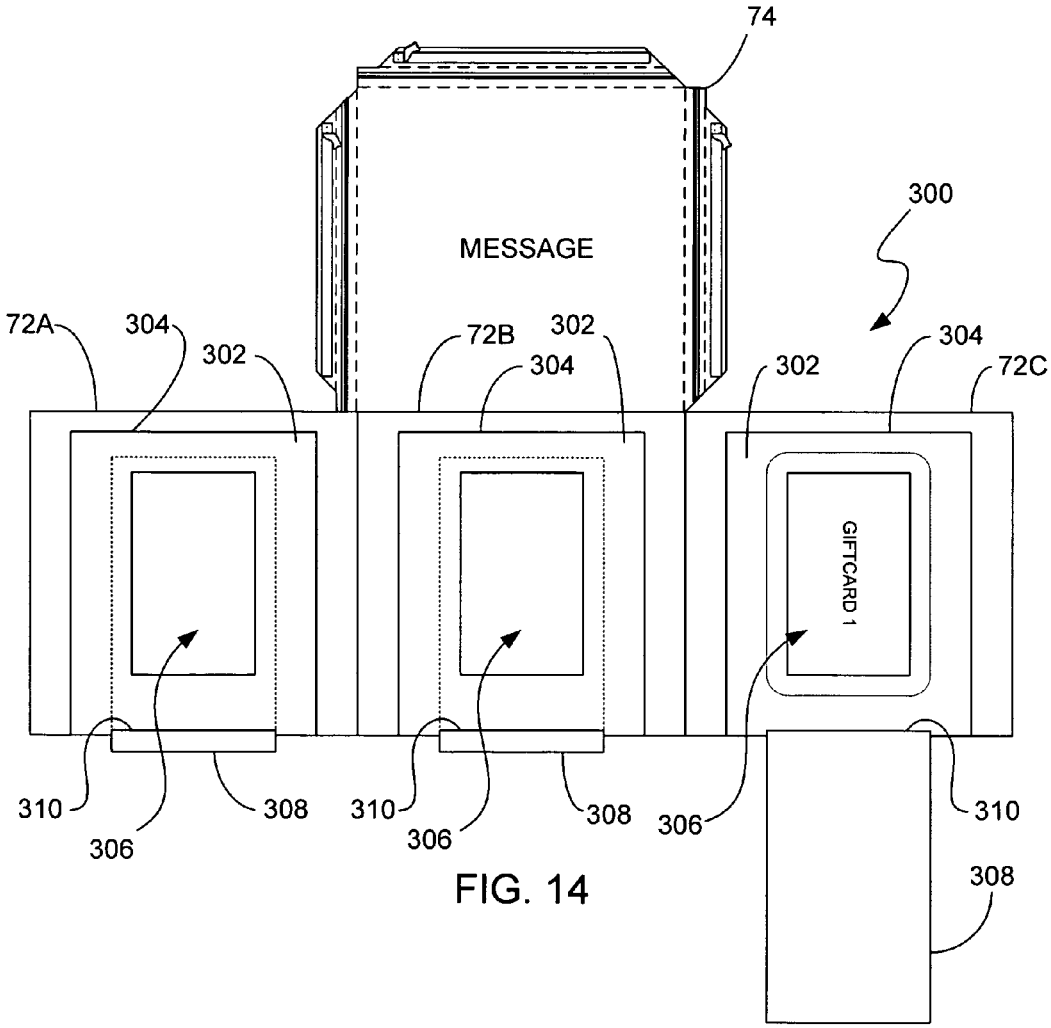
FIG. 14 is a front view diagram of a gift card envelope having pull outs, in accordance with one embodiment of the present invention.

FIG. 14 is a front view of a gift card envelope 300 including a pull out mechanism, in accordance with one embodiment of the present invention. The gift card envelope 300 includes pockets 302 for retaining the gift cards 71 to the panels 72. These pockets, however, also serve to mask the gift card 71. Each of the pockets 302 includes a slit 304 for receiving the gift card 71 therein and an opening 306 through which a portion of the gift card 71 can be seen when the gift card 71 is placed in the pocket 302 through the slit 304. The size of the opening 306 is typically less than the size of the gift card 71 so that the gift card 71 is fully retained within the pocket 302, i.e., doesn't slip out. The pull out mechanism includes one or more sliders or pull out tabs 308 that slide behind the opening 306 but in front of the gift card 71. The pull out tabs 308 are generally dimensioned to cover the opening 306. The pull out tabs 308 may be slidably retained within a slot 310 located at the bottom of a folded over pocket 302. The pull out tab 308 acts as a door that moves in front of the gift card 71 thereby hiding the gift card 71 within the pocket 302 (as shown in panel 72A). The pull out tab 308 also slides away from the opening 306 so as to expose the gift card 71 to the user (as shown in panel 72C).

Although the gift cards are shown and described as being placed independently on different panels, it should be noted that this is not a limitation and that multiple gift cards may be placed on a single panel.

Figure 15:
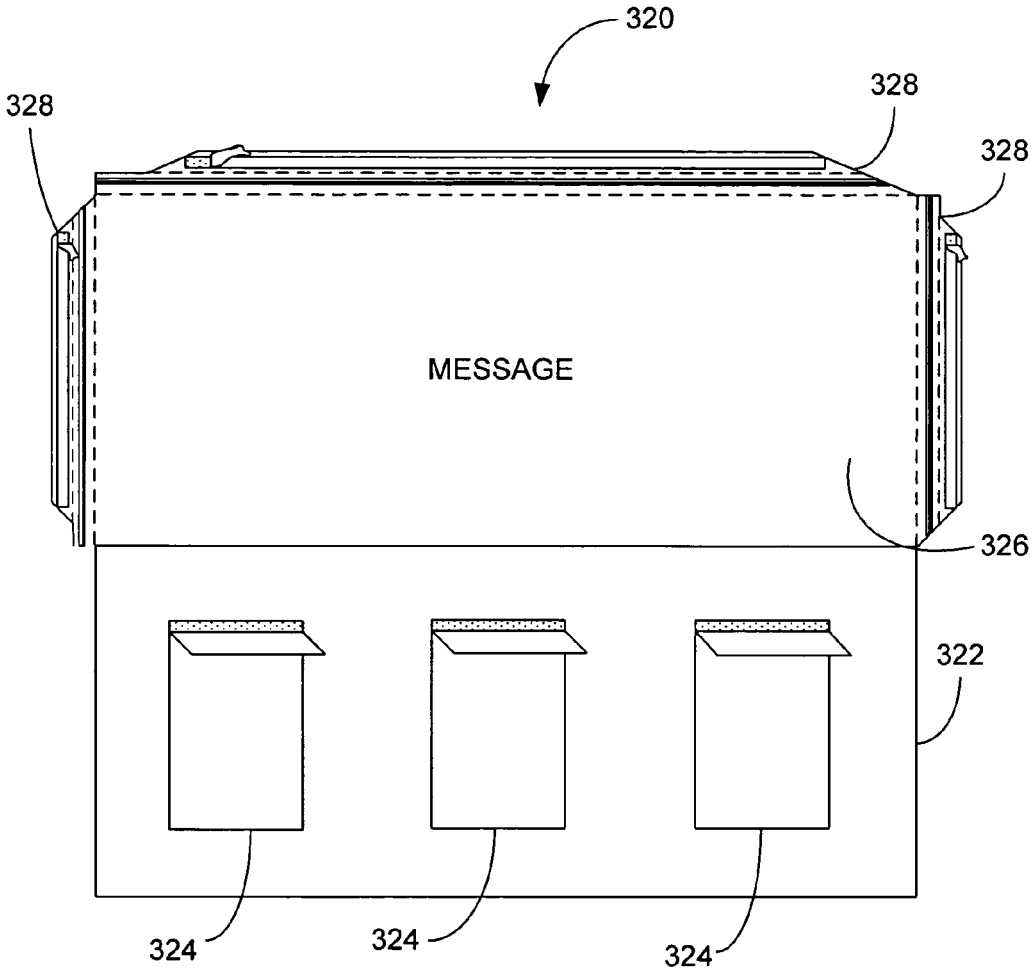
FIG. 15 is a front view diagram of a gift card envelope with a single panel for receiving multiple gift cards, in accordance with one embodiment of the present invention.

FIG. 15 is a front view diagram of a gift card envelope 320 with a single panel, in accordance with one embodiment of the present invention. The gift card envelope 320 includes a central panel 322. The central panel 322 includes a plurality of gift card retaining mechanisms 324. In the illustrated embodiment, the gift card retaining mechanisms 324 correspond to self adhesive strips. The gift card envelope 320 also includes a flap 326 that extends from a side of the central panel 322. The flap 326 is configured to fold over the central panel 322. The flap 326 is similar to the flap 84 disclosed in FIG. 3 and thus it includes a plurality of folding leaves 328 for sealing the edges found between the central panel 322 and flap 326 as well for attaching the flap 326 to the central panel 322. The folding leaves 228 may for example include self adhesive strips and tear strips in a manner analogous to the folding leaves 84 shown in FIG. 3.

Moreover, although only a box like shape is shown in FIG. 10, it should be noted that other shapes may be produced by the gift card envelope. For example, the gift card envelope may be configured to fold into a more complex shape such as a car or house. In cases such as these, the gift cards retained there may be associated with the particular shape of the gift card envelope. For example, a gift card envelope in the shape of a car may include gift cards from automotive supply stores, car dealerships repair shops and the like. Furthermore, a gift card envelope in the shape of a home may contain gift cards from hardware/lumber stores or furniture stores.

Figure 16:
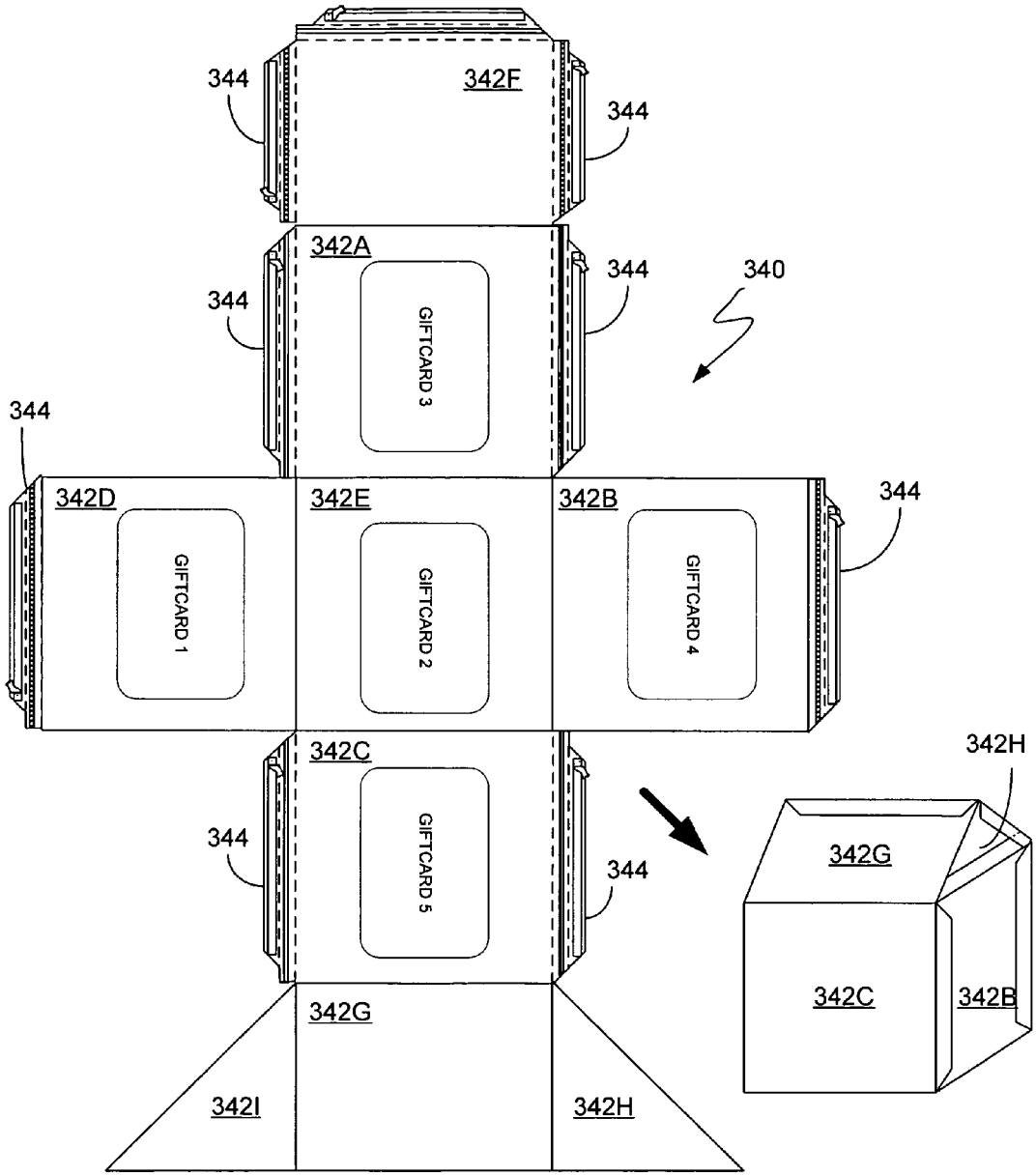
FIG. 16 is a front view diagram of a gift card envelope and its corresponding shaped gift box formed therefrom, in accordance with one embodiment of the present invention.

FIG. 16 is a front view diagram of a gift card envelope 340, in accordance with one embodiment of the present invention. In this particular embodiment, the panels 342 can be folded into a home 344. When folded, the gift cards 71 are hidden within the home 344. The sides of the home are formed by panels 342A-D. The base of the home is formed by panel 342E. The roof of the home are formed by panels 342F-G, and the trusses that support the roof are formed by panels 342H-I. Similar to the box shown in FIG. 10, various panels 342 include folding leaves 344 in order to seal the edges between panels 342.

While this invention has been described in terms of several preferred embodiments, there are alterations, permutations, and equivalents, which fall within the scope of this invention. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

What is claimed is:

1. A gift card envelope, comprising:

a central panel having at least a pair of outer panels and flap extending therefrom, the panels and flap being formed from a single sheet of material, the outer panels and flap being foldable relative to the central panel, the outer panels and flap folding in towards the central panel so as to close the gift card envelope, the panels and flap forming consecutive layers that overlap one another, each of the panels including a gift card retaining mechanism only on its front side for removably attaching a different gift card, the flap including folding leaves extending therefrom, the folding leaves being configured to fold around the edges of the panels in order to close off any gaps found between the folded panels, the folding leaves providing a surface for attaching to the back side of the central panel, the folding leaves including a self adhesive strip and a tear strip, the self adhesive strip being positioned towards the outer edge of the folding leaves, the tear strip being positioned between the self adhesive strip and the folds that divide the folding leaves from the flap, the adhesive layer of the self adhesive strip being configured to form a permanent bond between the folding leaves and the backside of the central panel, the tear strip being provided to tear the folding leaves apart thereby releasing the flap from the back side of the central panel.

2. The gift card envelope as recited in claim 1 wherein the gift card retaining mechanism is a self adhesive strip, the self adhesive strip including an adhesive layer and a strip that is disposed over the adhesive layer, the adhesive layer is configured to temporarily bond a gift card to the panel when the strip is removed and the gift card is laid over the adhesive layer.

3. The gift card envelope as recited in claim 1 wherein the gift card retaining mechanism is a pocket including a pouch for receiving a gift card.

4. The gift card envelope as recited in claim 3 wherein the pockets are integrally formed from the panels.

5. The gift card envelope as recited in claim 1 wherein the gift card retaining mechanism is a window pocket capable of receiving an entire gift card.

6. The gift card envelope as recited in claim 1 wherein the flap is positioned above the central panel, and the outer panels are positioned at least to the right and left of the central panel.

7. The gift card envelope as recited in claim 1 wherein the central panel and outer panels are sized and shaped so that only one gift card can be retained thereon.

8. The gift card envelope as recited in claim 1 wherein the central panel, outer panels and flap have substantially the same size and shape.

9. The gift card envelope as recited in claim 1 wherein the flap is coupled to the central panel along one of its sides, and wherein the remaining sides of the flap each include folding leaves.

10. A gift card envelope configured to receive, hold and enclose two or more gift cards, comprising:

a first panel having a first gift card retaining mechanism for removably attaching a first gift card thereto; and a second panel having a second gift card retaining mechanism for removably attaching a second gift card thereto, the second gift card representing a different store than the first gift card, wherein the first and second panels are movable relative to one another so that the gift card envelope can be opened and closed, the gift cards when held by the gift card retaining mechanism being presented to a receiver of the gift card envelope when the gift card envelope is opened, the gift cards when held by the gift card retaining mechanism being hidden from the receiver when the gift card envelope is closed; and are stacked over each other when closed and further comprising a flap movable relative to a first one of the panels, the flap moving between a first position where the flap is laid out next to the first one of the panels, and a second position where the flap is laid over the stacked first and second panels, the flap including folding leaves extending therefrom, the folding leaves being configured to wrap around the edges of the stacked first and second panels when the flap is in the second position in order to close off any gaps found between the stacked panels.

11. The gift card envelope as recited in claim 10 wherein the panels are formed from sheets or films of paper, cardboard, or plastic.

12. The gift card envelope as recited in claim 10 wherein the panels are configured to pivot, translate, rotate relative to one another.

13. The gift card envelope as recited in claim 12 wherein the panels are integrally formed, and wherein the panels pivot relative to one another, the pivot being provided by a fold between the integrally formed panels.

14. The gift card envelope as recited in claim 10 wherein gift card retaining mechanism are selected from self adhesive strips, glue, double sided tape, pockets, picture corners, bands, slots or slits.

15. The gift card envelope as recited in claim 10 further including an envelope holding mechanism configured to keep the panels in the closed position, and to allow the panels to be opened, and wherein the envelope holding mechanism is selected from tape, glue, self adhesive strips, tear strips, ribbons, inserts, stickers or labels.

16. The gift card envelope as recited in claim 10 further comprising:

a third panel having a third gift card retaining mechanism for removably attaching a third gift card thereto, the third gift card representing a different store than the first and second gift cards; and a central panel to which each of the first, second and third panels are movable coupled, the first, second, and third panels folding toward the central panel in order to close the gift card envelope.

17. The gift card envelope as recited in claim 10 wherein the first and second panels each have an exterior and interior side and wherein the retaining mechanisms are only disposed on the interior side of their respective panels.

18. The gift card envelope as recited in claim 10 further comprising:

a third panel having a third gift card retaining mechanism for removably attaching a third gift card thereto, the third panel being movable relative to the second panel such that the second panel is a central panel, the first and third panels being laid out next to the second panel when the gift card envelope is opened, the first, second and third panels being stacked over each other when the gift card envelope is closed.

* * * * *